United States Patent [19]

Nagata et al.

[11] Patent Number: 4,650,449

[45] Date of Patent: Mar. 17, 1987

[54] PACKING PAPER RECEIVING AND FOLDING APPARATUS

[75] Inventors: Tomizou Nagata; Makoto Sakano, both of Tokyo, Japan

[73] Assignee: Japan Tobacco Inc., Tokyo, Japan

[21] Appl. No.: 650,029

[22] Filed: Sep. 13, 1984

[30] Foreign Application Priority Data

Sep. 13, 1983 [JP] Japan ..... 58-167585

[51] Int. Cl.[4] ..... B31B 1/60

[52] U.S. Cl. ..... 493/84; 493/93; 493/164; 493/910; 53/234; 53/575

[58] Field of Search ..... 53/575, 234, 578; 493/84, 88, 93, 101, 111, 112, 113, 164, 176, 408, 470, 471, 473, 907, 910, 129, 133, 141

[56] References Cited

U.S. PATENT DOCUMENTS

| | | | |
|---|---|---|---|
| 3,579,952 | 5/1971 | Davies | 53/529 |
| 4,183,191 | 1/1980 | Focke | 53/234 |
| 4,330,976 | 5/1982 | Blackall et al. | 53/234 |

*Primary Examiner*—Frederick R. Schmidt
*Assistant Examiner*—Robert Showalter
*Attorney, Agent, or Firm*—Armstrong, Nikaido, Marmelstein & Kubovcik

[57] ABSTRACT

A packing paper receiving and folding apparatus is disclosed. It has a rotatable suction ring including a bracket, a pair of suction arms axially supported at their one ends in a pivotable manner with respect to the bracket, the other ends of the suction arms defining an opening portion between them so that an arbor can enter from there, folding claws mounted on the inside of at least one of the suction arms, and a bottom clamp positioned in the opening portion to complete the suction ring having substantially an annular outer periphery; a U-clamp provided within the suction ring for body folding, a main presser for pressing an inner bag provided within the suction ring in such a manner as to be openable; and a seaming clamp approaching to and departing from the arbor.

3 Claims, 54 Drawing Figures

FIG. 1f
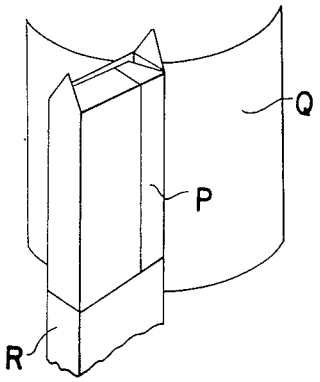
FIG. 1g FIG. 1h
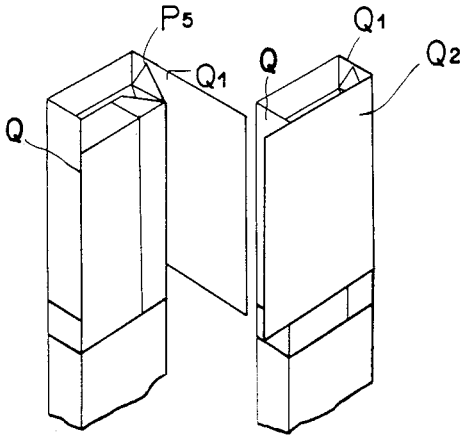
FIG. 1i FIG. 1j FIG. 1k FIG. 1ℓ
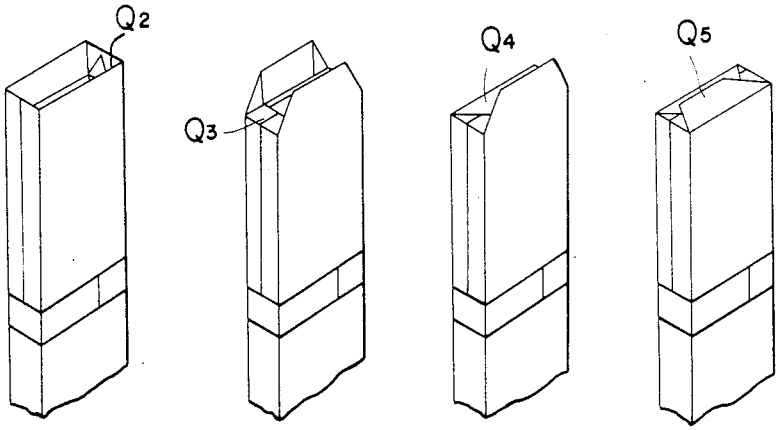

103
104
O
102
86
R
101
100
99
171
99a 96
92d
92b
94
A
95'
92c
95
93
N
n
89
88
92
97
86'
87
92a
86
91

PACKING PAPER RECEIVING AND FOLDING APPARATUS

BACKGROUND OF THE INVENTION

The present invention relates to a packing paper receiving and folding apparatus in a packing process of cigarettes, etc. and more particularly to an apparatus for receiving and folding a packing paper for forming an outer bag.

In the packing process of cigarettes, a desired number of cigarettes are stacked in such a manner as to form a honeycomb pattern as viewed from the end. Further, an aluminum foil which is a packing paper forms an inner bag and a package paper which is a packing paper forms an outer bag wound around an arbor as a bag forming tool or a jig in a square sleeve shape. Both ends thereof are opened and folded into a double bag with one end thereof closed and then, the stacked cigarettes are pushed into the arbor from one end portion thereof and pushed out from the other end portion thereof, so that the desired number of cigarettes are accommodated in said double bag.

FIGS. 1*a* through 1*l* illustrates an outline of such a packing process. Regarding the aluminum foil P in the first step, an arbor R is moved into a supporting member for supporting an aluminum foil P which is cut into a predetermined dimension in advance (FIG. 1*a*), the aluminum foil P is wound around the body of the arbor R and a bottom inner flap $P_1$ is folded (FIG. 1*b*). After a body inner flap $P_2$ is folded (FIG. 1*c*), a body outer flap $P_3$is folded (FIG. 1*d*). Lastly, a bottom outer flap $P_4$ is folded in such a manner as to leave a pair of triangle ears in an opposite relationship with respect to each other at the bottom portion (FIG. 1*e*). In this state, as a second step, the arbor R is entered into a supporting member for supporting a package paper Q (FIG. 1*f*), and while maintaining a body inner flap $Q_1$ in the folded state, the package paper is wound around the arbor R (FIG. 1*g*). After the folding of the body is effected (FIG. 1*h*), a body outer flap $Q_2$ is folded (FIG. 1*i*). As a third step, a pair of bottom ears of the package paper are folded (FIG. 1*j*), and after a bottom inner flap $Q_4$ is folded (FIG. 1*k*), a bottom outer flap $Q_5$ is folded (FIG. 1*l*). Since an adhesive agent is applied to the body outer flap $Q_2$ and the bottom outer flap $Q_5$ in advance, these flaps are attached to the body inner flap $Q_1$ and the bottom inner flap $Q_4$, respectively.

The present invention has developed a novel apparatus for forming an outer bag in the above-mentioned double bag forming process.

The conventional packing apparatus of this type so far as known is the one disclosed in U.S. Pat. No. 3,579,952. According to this prior art, a supporting member having an opening portion receives and supports the package paper throughout said opening portion. Then, a core material enters into said opening portion to perform a U-shaped body folding and moves further in this state. While moving in said state, the core material is subjected to the folding job of the body inner and outer flaps by means of common folding claw to complete the job to wind the package paper therearound. In this prior art, however, a position regulating means for the package paper is not sufficiently provided when it is received. Furthermore, when the package paper is folded in a U-shape, the folding is effected in the state where the package paper is not yet sufficiently sandwiched between and held by the core material and the receiving plate. As a result, dislocation of the package paper arises with respect to the core material. Furthermore, since the folding is effected while the core material is moving in order to complete the body winding of the package paper, sufficiently tensioned folding is not available and maintenance after the folding is insufficient as well, thus resulting in a loosening thereof. As a consequence, the quality of the resulting goods is not uniform. Also, this is a neck for operation in the packing job at a high speed.

The present invention was accomplished in view of the above.

SUMMARY OF THE INVENTION

It is therefore a general object of the present invention to provide a packing paper receiving and folding apparatus, wherein the packing paper for forming an outer bag is received and supported by a suction ring through an opening portion thereof, and then sandwiched between and held by an arbor and a bottom clamp, and the folding operation is carried out all within the suction ring, so that the packing operation can be effected at a high speed and that a uniform quality of the resulting goods can be obtained.

It is another object of the invention to provide a packing paper receiving and folding apparatus which can effectively avoid dislocation of the outer bag packing paper when it is received.

A further object of the present invention is to provide a packing paper receiving and folding apparatus which can complete the folding operation before loosening of the outer bag packing paper occurs with respect to the arbor, serving as a core member.

Still a further object of the present invention is to provide a packing paper receiving and folding apparatus which can fold the outer bag packing paper with sufficient tension.

An even further object of the invention is to provide a packing paper receiving and folding apparatus which can maintain a satisfactory folding state of the outer bag packing paper during and after each step of the folding operation.

An additional object of the present invention is to provide a packing paper receiving and folding apparatus, wherein a main presser is provided in order to properly press the inner bag upon which the outer bag packing paper is folded.

To achieve the above objects and others, there is essentially provided a packing paper receiving and folding apparatus comprising a rotatable suction ring including a bracket, a pair of suction arms axially supported at one ends thereof in a pivotable manner with respect to said bracket, the other ends of said suction arms defining an opening portion therebetween so that an arbor served as a core member for forming a bag can enter therethrough, folding claws mounted on the inside of at least one of said suction arms, and a bottom clamp positioned in said opening portion to complete the suction ring having substantially an annular outer periphery, said bottom clamp being movable to and fro with respect to said opening portion; a U-clamp provided within said suction ring for body folding; a main presser for pressing an inner bag provided within said suction ring in such a manner as to be opened and closed; and a seaming clamp approaching to and departing from said arbor.

BRIEF DESCRIPTION OF THE DRAWINGS

FIG. 1 is a schematic view showing the steps of forming of a double bag, specifically, FIGS. 1*a* through 1*l* show the forming steps;

DETAILED DESCRIPTION OF THE EMBODIMENTS

Preferred embodiments of the present invention will be described hereunder with reference to the accompanying drawings.

A packing drum A is provided with 48 pcs. in total of suction rings of a cylindrical configuration partly cut; 24 pcs. of suction ring B and 24 pcs. of suction ring C, respectively along its outer periphery. Said suction rings B and C are arranged in two rotary rows and in tandem in the direction of the rotary shaft on the packing drum A, so that they form one set for forming bags of aluminum foil P and package paper Q as will be described hereinafter.

The 24 pcs. of suction ring B are used to receive aluminum foil P and wind it around the arbor R, while the other 24 pcs. of suction ring C are for receiving package paper C and winding it around the arbor R. In the close vicinity of the outer periphery of said packing drum A, and in the rotary rows of said aluminum suction rings B as well as said package paper suction rings C, one piece of each of aluminum foil feed drums D and package paper feed drums E is provided in such a manner as to be normally rotated. In accordance with the rotation of the packing drum A, the aluminum foil feed drum D feeds the aluminum foil P cut in a predetermined dimension to a corresponding suction ring B in a sequential manner. Likewise, the package paper feed drum E feeds the package paper Q of a predetermined dimension to a corresponding suction ring C in a sequential manner.

Said aluminum suction rings B and said package paper suction rings C are arranged in opposite relationship with respect to the arbors R, respectively. These arbors R are arranged to be movable independently in the radial direction of the packing drum A. They are also arranged to be movable in the axial direction to effect a shifting of the positions of an arbor change. The arbor R which completed the bag forming job of the aluminum foil P is exchanged with another arbor R which is positioned in the other side in the axial direction by means of mutual movements in the axial direction, and engages in the bag forming job of the package paper Q upon the aluminum foil bag in the other rotary row with respect to the axial direction.

Figure 1A:
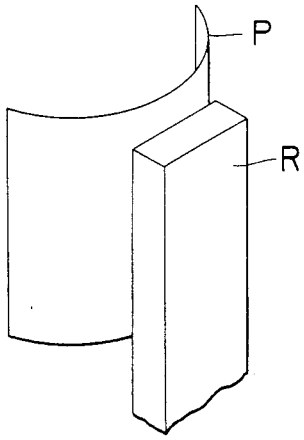
Figure 1B:
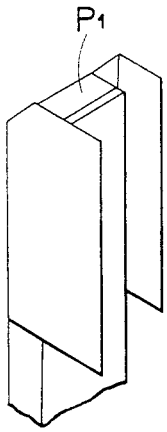
Figure 1C:
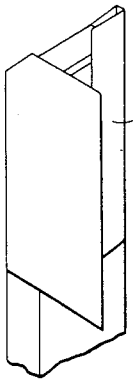
Figure 1D:
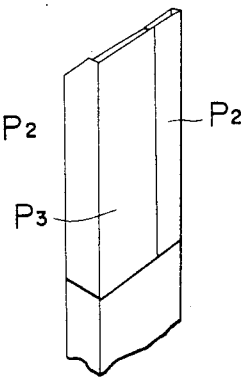
Figure 1E:
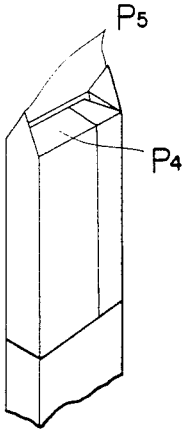
Figure 2:
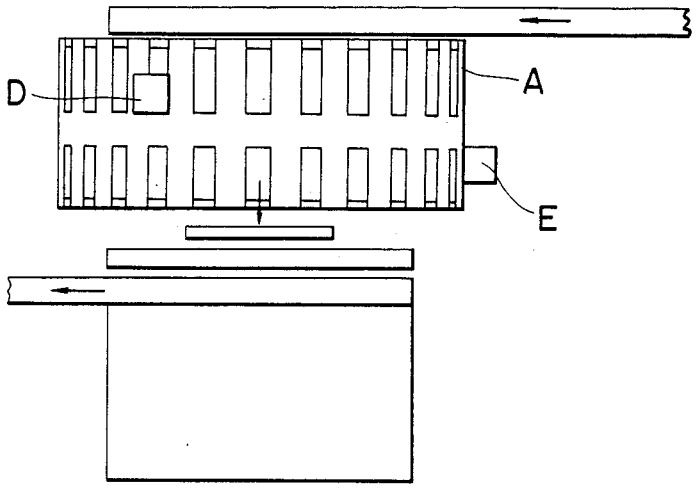
FIG. 2 is a plan view showing the outline of a packing drum.
Figure 3:
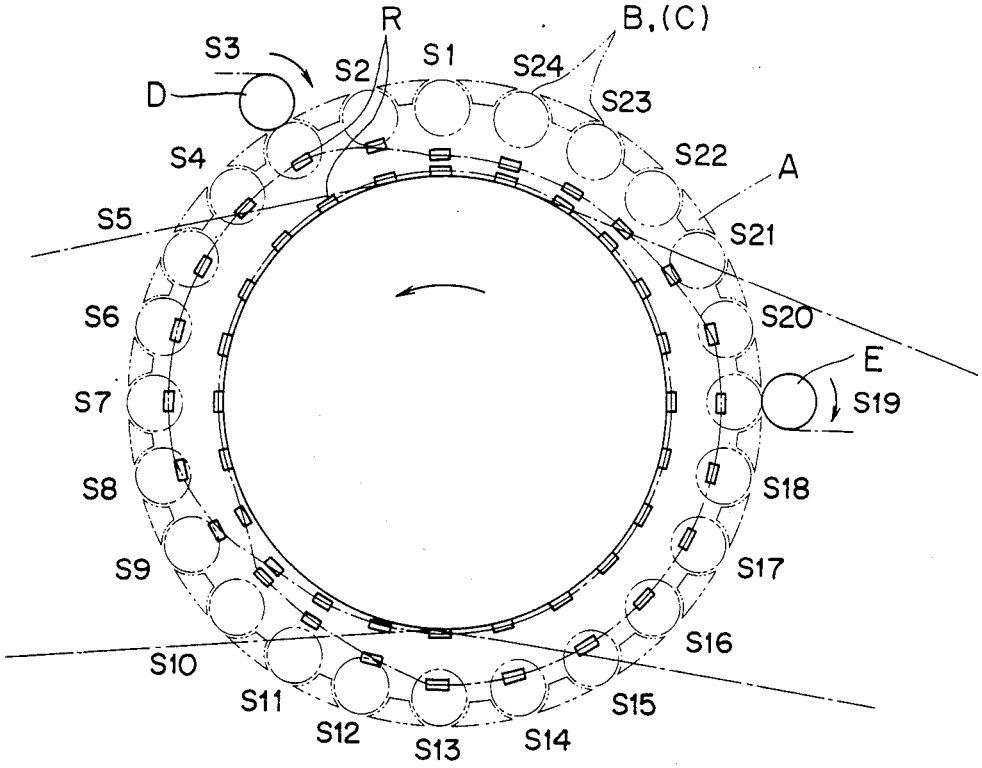
FIG. 3 is a front view showing the outline of the packing drum.
Figure 4:
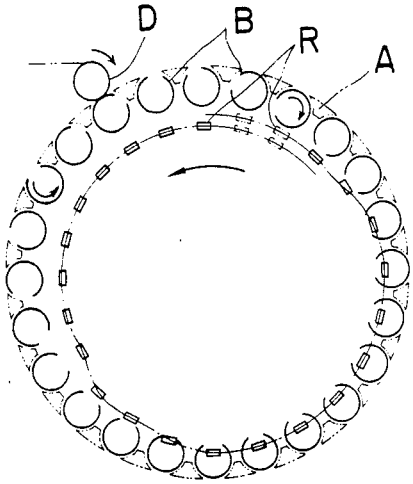
FIG. 4 is a front view showing schematically the movement of arbors with respect to suction rings in the process for receiving and folding aluminum foil to be used for an inner bag.
Figure 5:
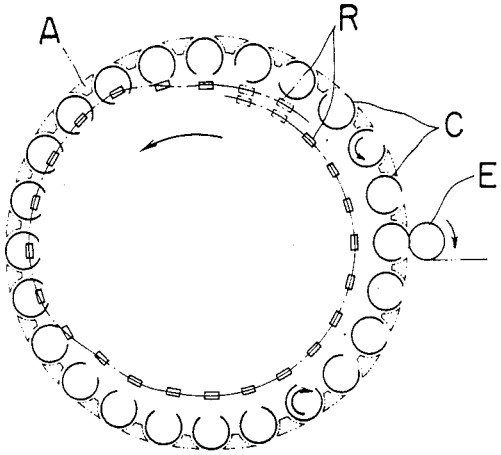
FIG. 5 is likewise a front view showing schematically the movement of arbors with respect to suction rings in the process for receiving and folding package paper to be used as an outer bag.
Figure 6:
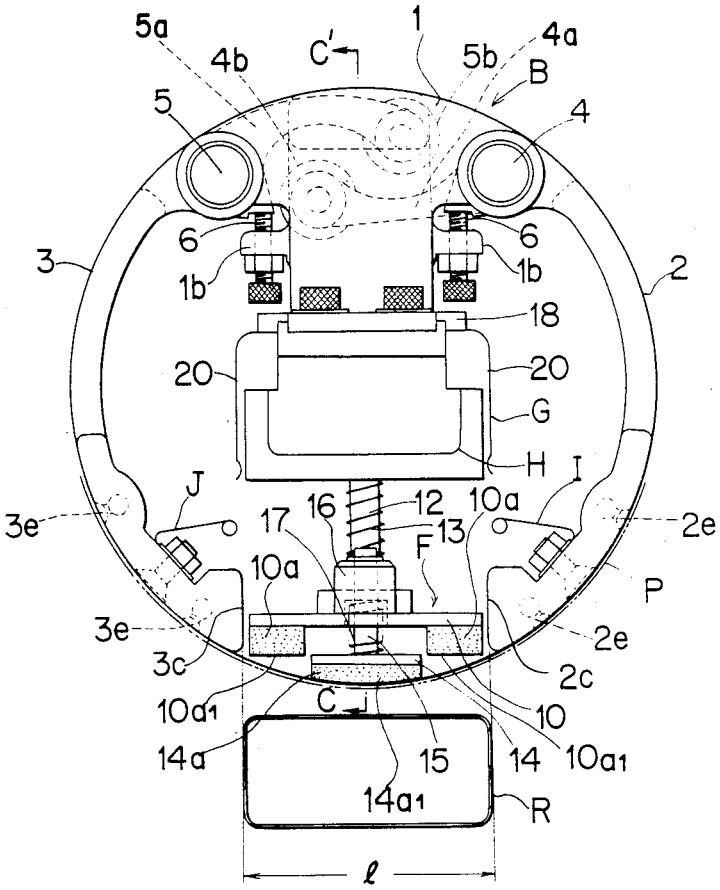
FIG. 6 is a front view showing the aluminum foil suction ring.
Figure 7:
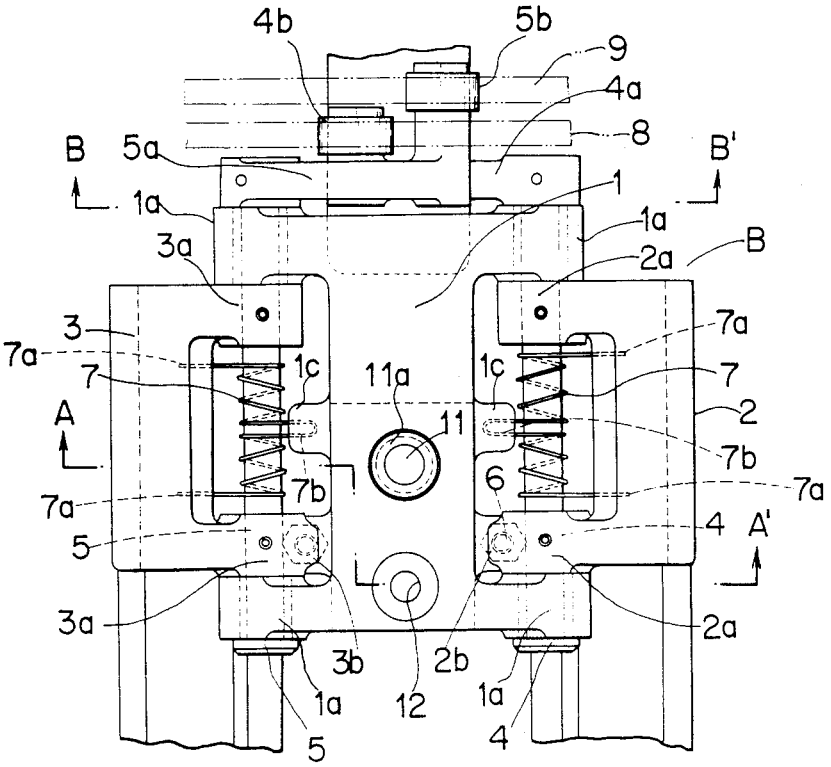
FIG. 7 is a plan view of the above.
Figure 8:
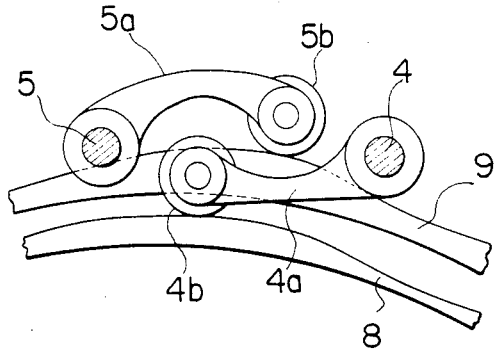
FIG. 8 is a sectional view taken on line B—B′ of FIG. 7.
Figure 9:
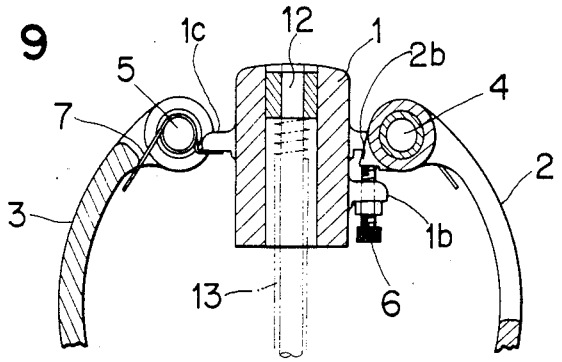
FIG. 9 is likewise a sectional view taken on line A—A′ of FIG. 7.
Figure 10:
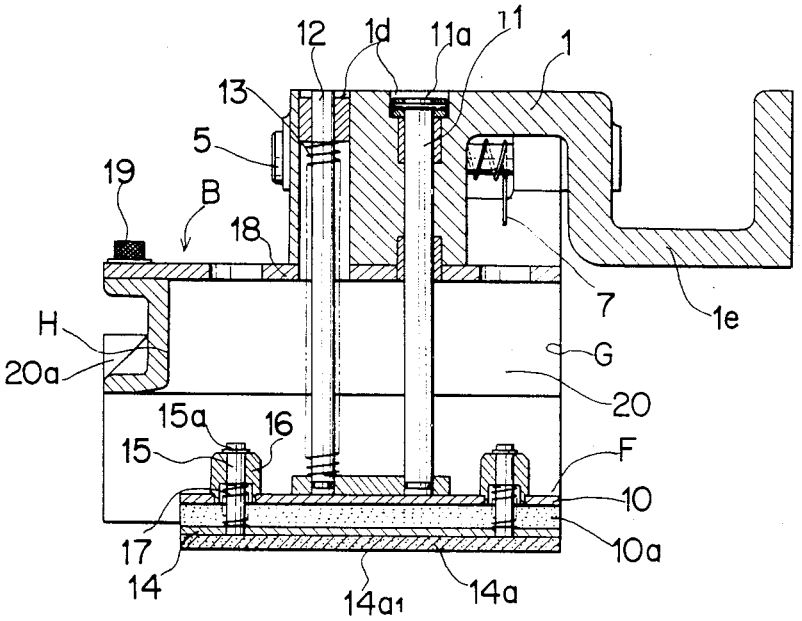
FIG. 10 is a sectional view taken on line C—C′ of FIG. 6.
Figure 13:
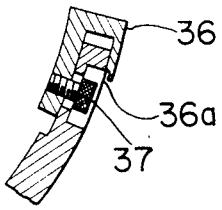
FIG. 13 is an enlarged sectional view of the aluminum foil stopper.
Figure 14:
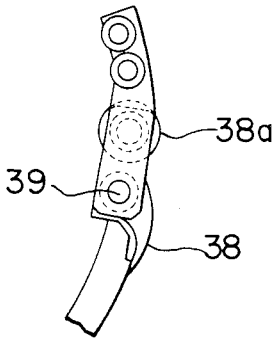
FIG. 14 is an enlarged sectional view of the aluminum foil clamping claw.
Figure 11:
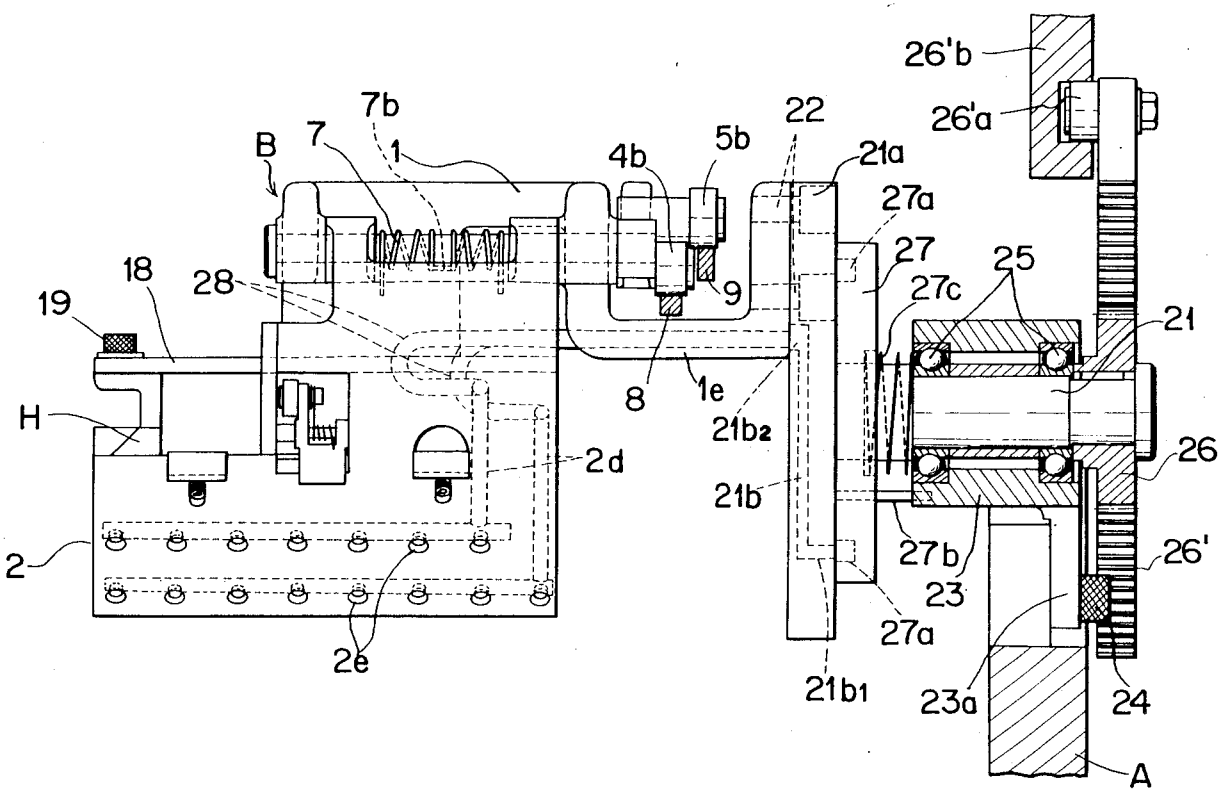
FIG. 11 is a side view of the aluminum foil suction ring.
Figure 12:
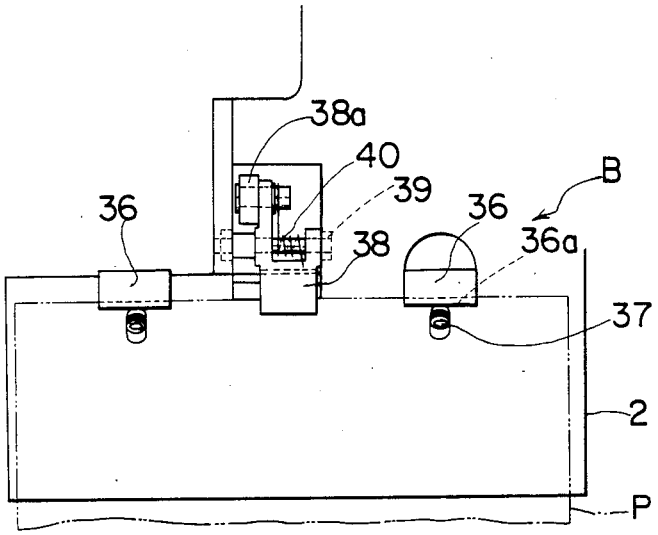
FIG. 12 is an enlarged side view showing the of an aluminum foil stopper and a clamping claw.
Figure 18:
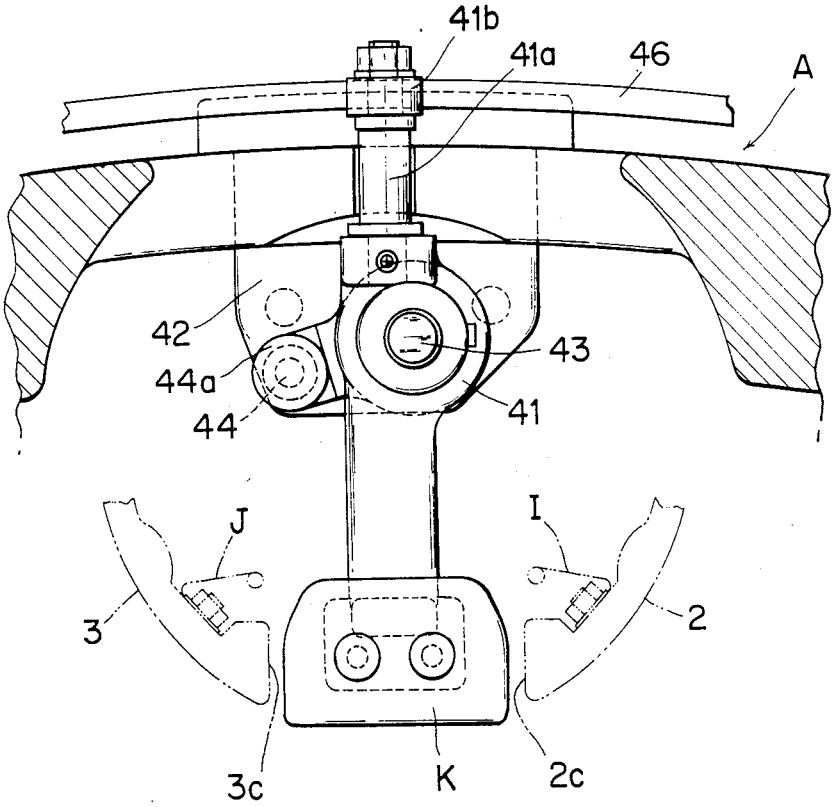
FIG. 18 is a rear view of a bottom outer flap folding claw.
Figure 15:
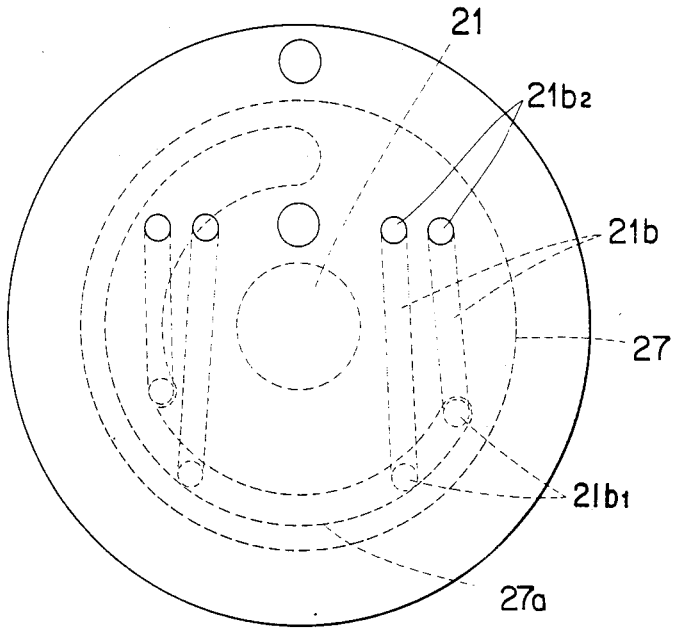
FIG. 15 is a detailed view of a control ring of the aluminum foil.
Figure 16:
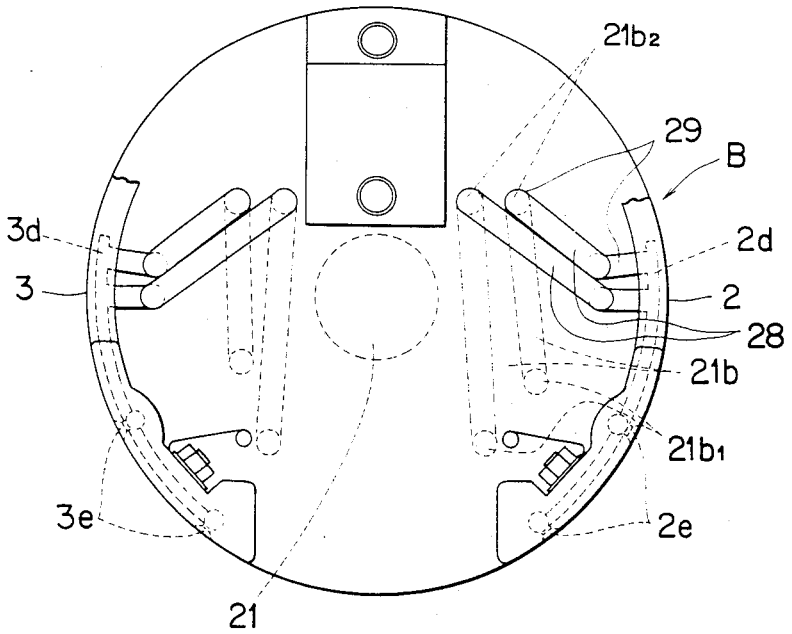
FIG. 16 is a detailed view of an aluminum foil suction transfer mechanism.
Figure 17:
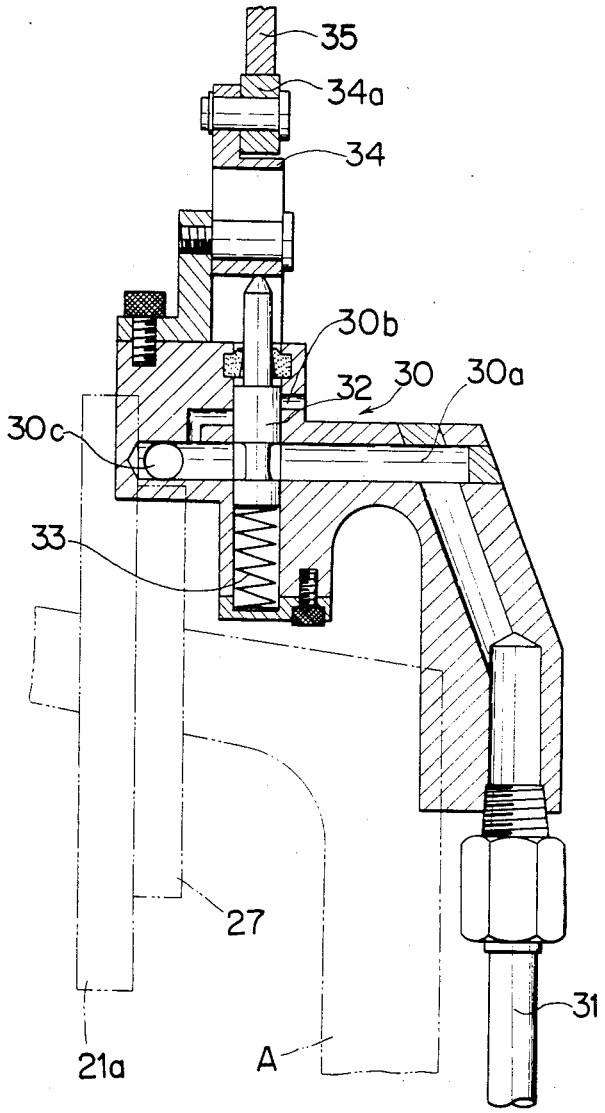
FIG. 17 is a sectional view of a suction cut-off valve portion.
Figure 19:
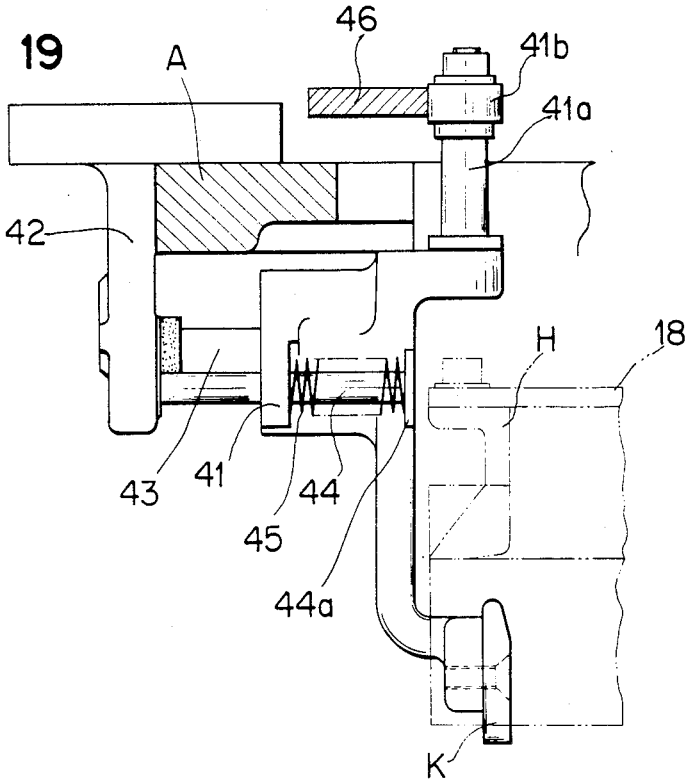
FIG. 19 is a side view of the above.
Figure 22:
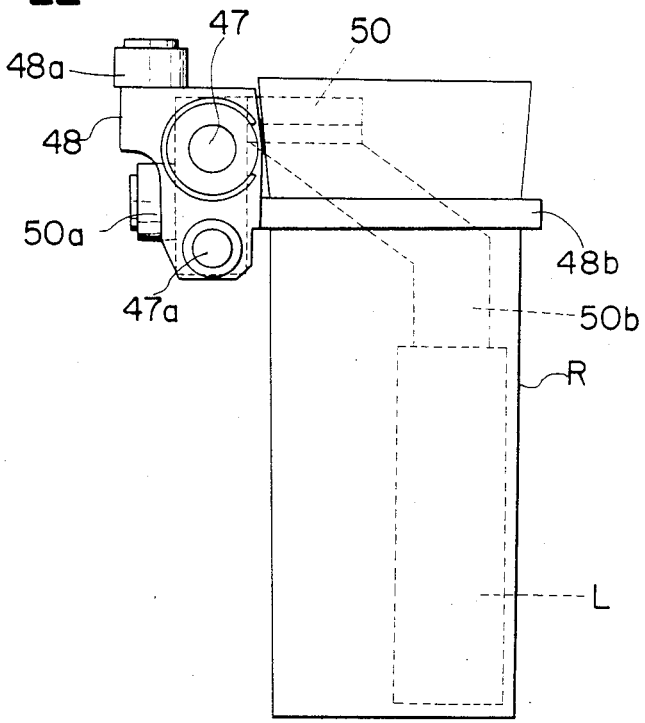
FIG. 22 is a plan view of an arbor supporting mechanism.
Figure 20:
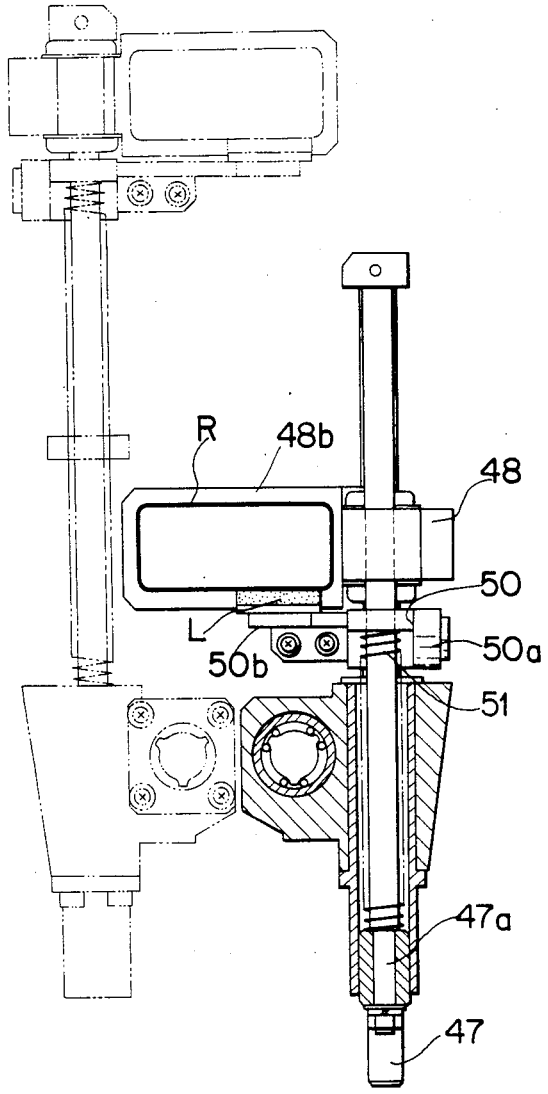
FIG. 20 is a front view showing an arbor and seaming clamp supporting mechanism.
Figure 21:
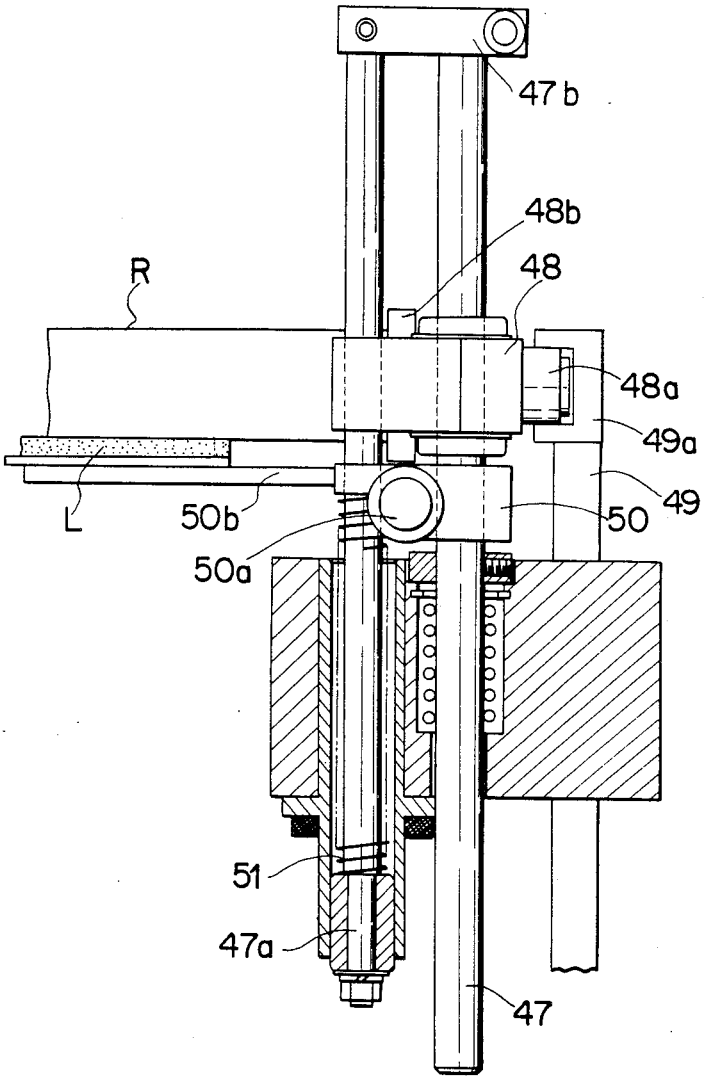
FIG. 21 is a side view of the above.
Figure 23:
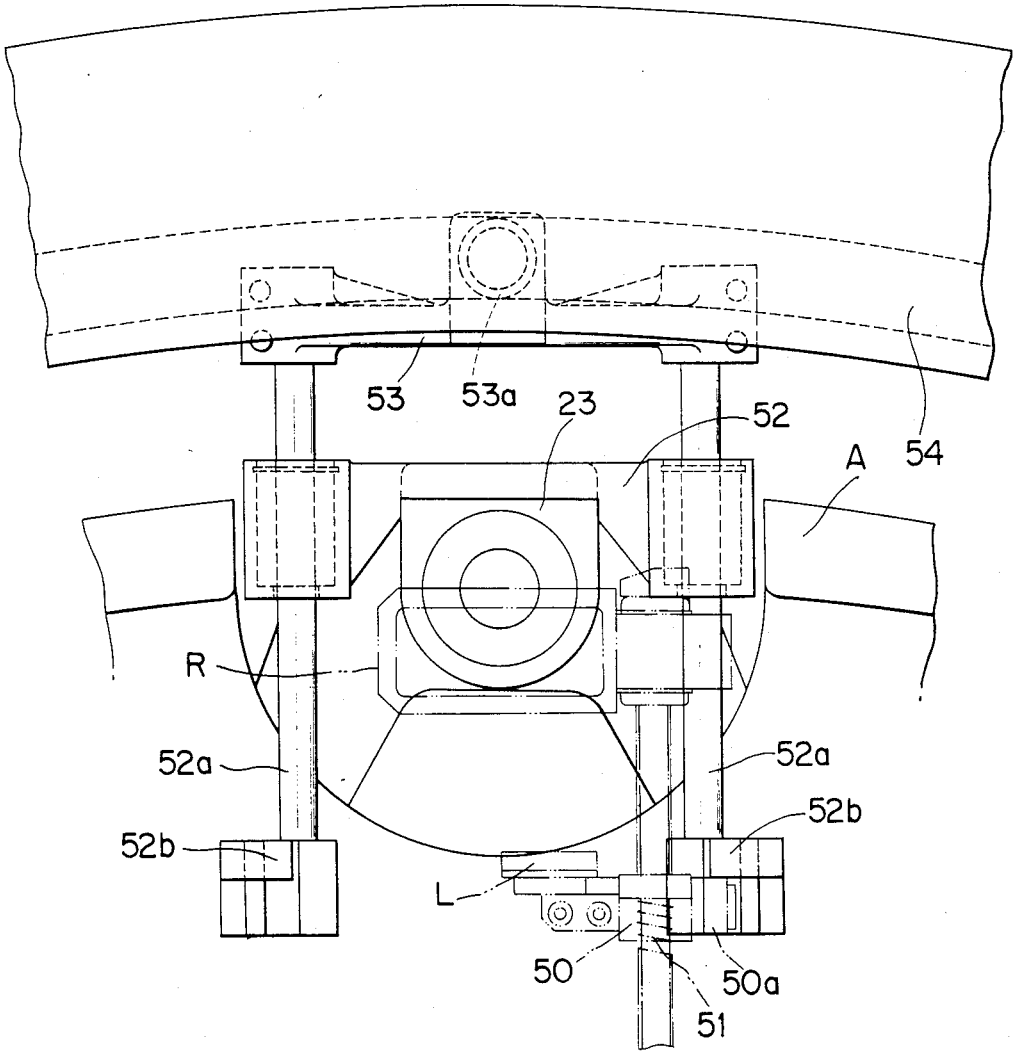
FIG. 23 is a front view of a seaming clamp driving mechanism.
Figure 24:
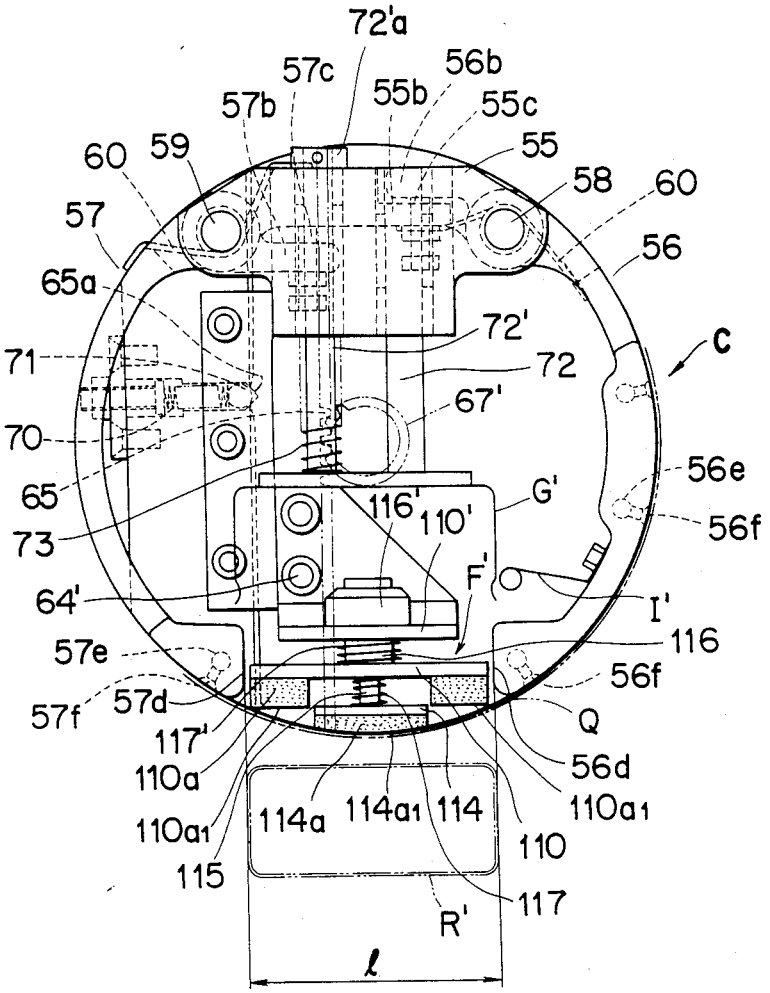
FIG. 24 is a rear view of a package paper suction ring.
Figure 25:
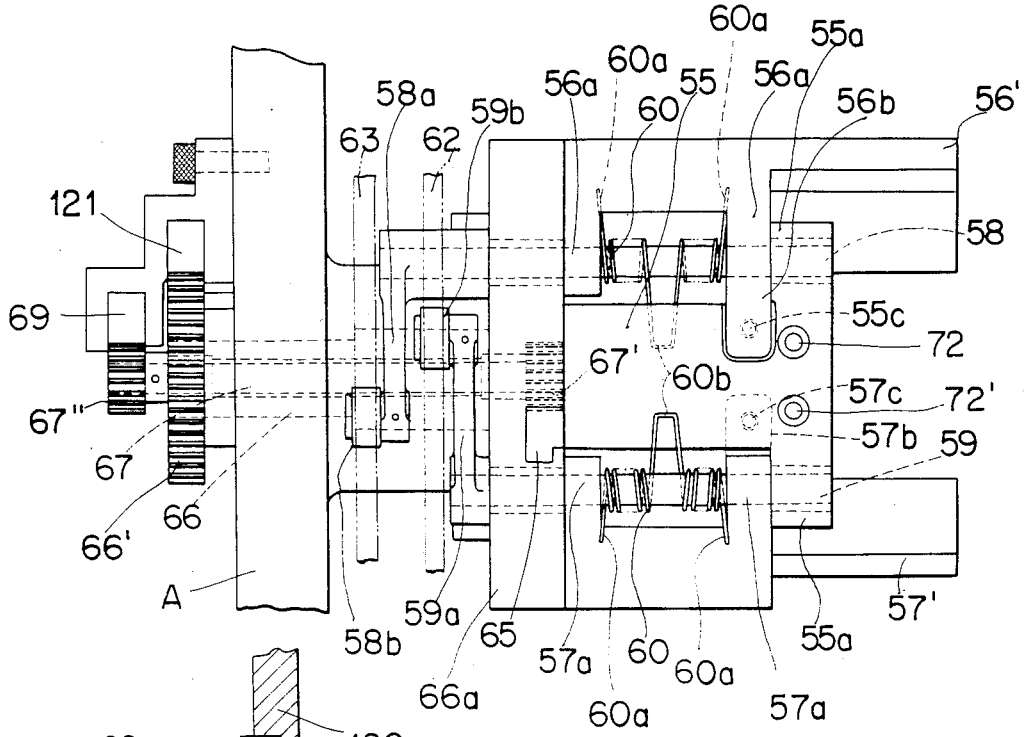
FIG. 25 is a plan view of the above.
Figure 26:
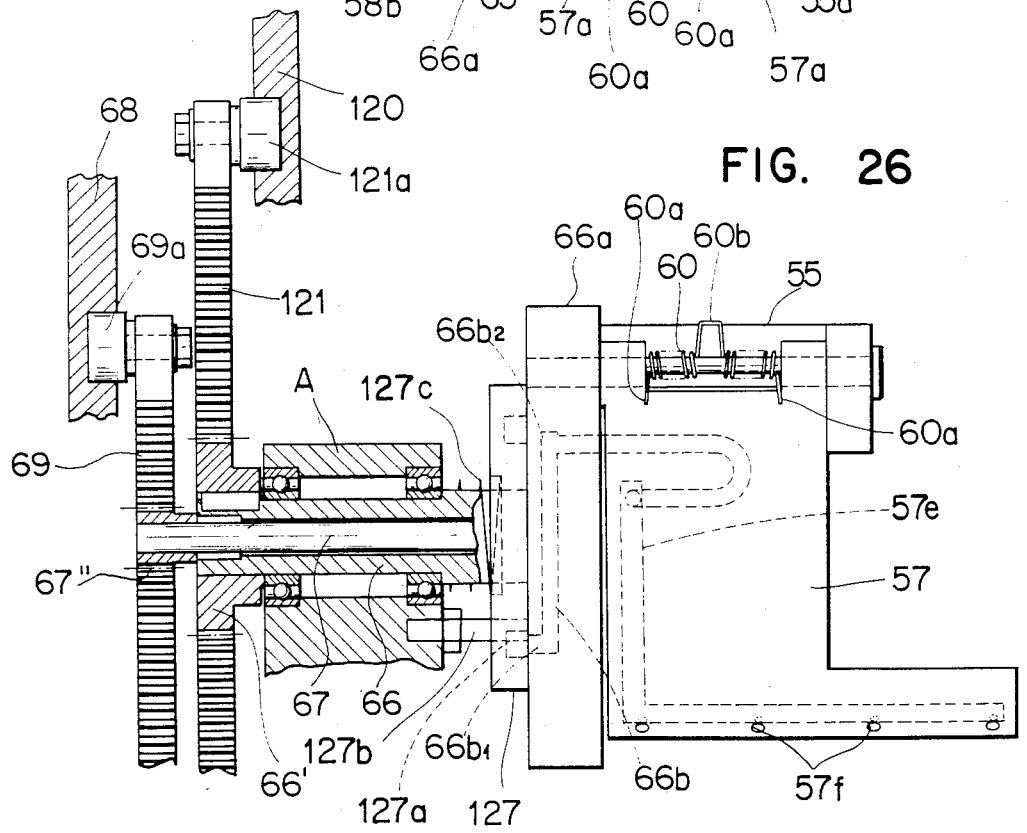
FIG. 26 is an exploded side view of the above showing a suction ring shaft portion.
Figure 27:
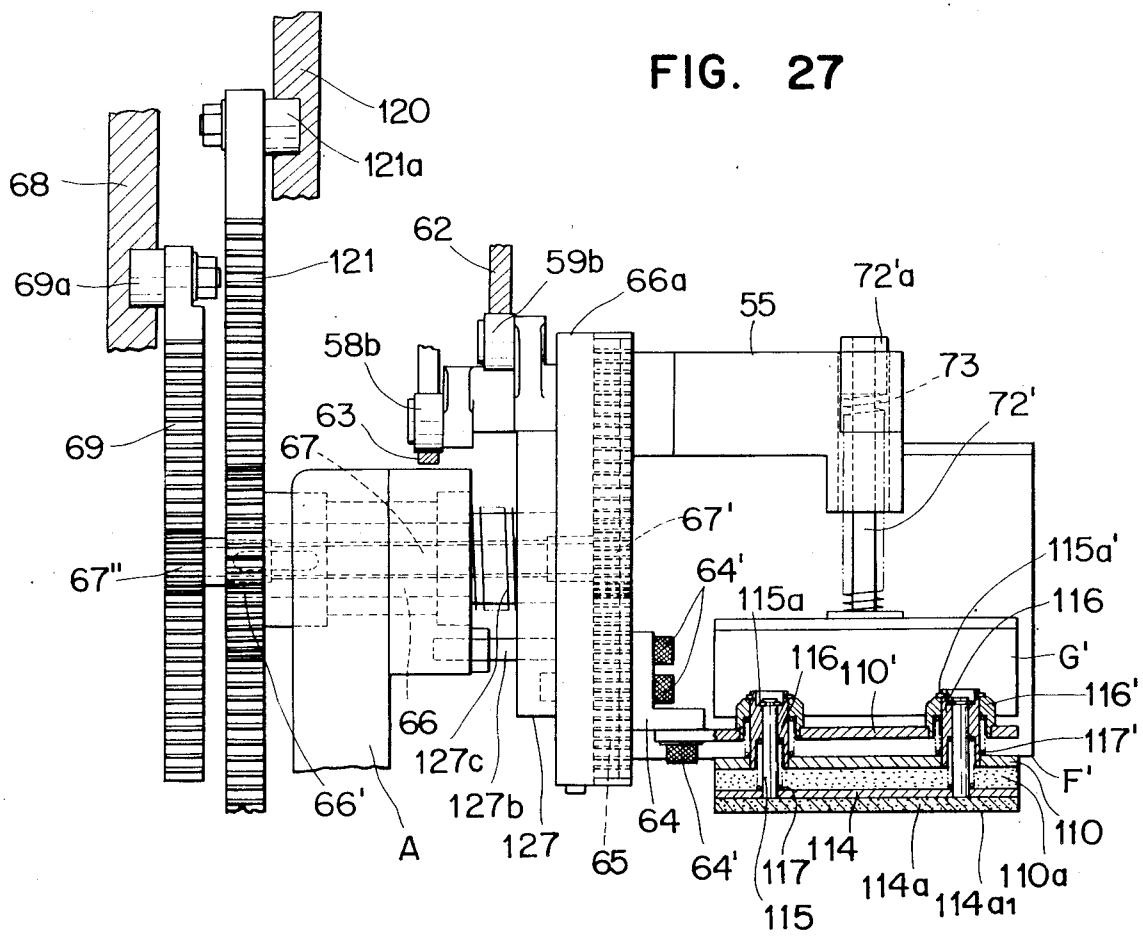
FIG. 27 is an exploded side view of the above showing a bottom clamp.
Figure 28:
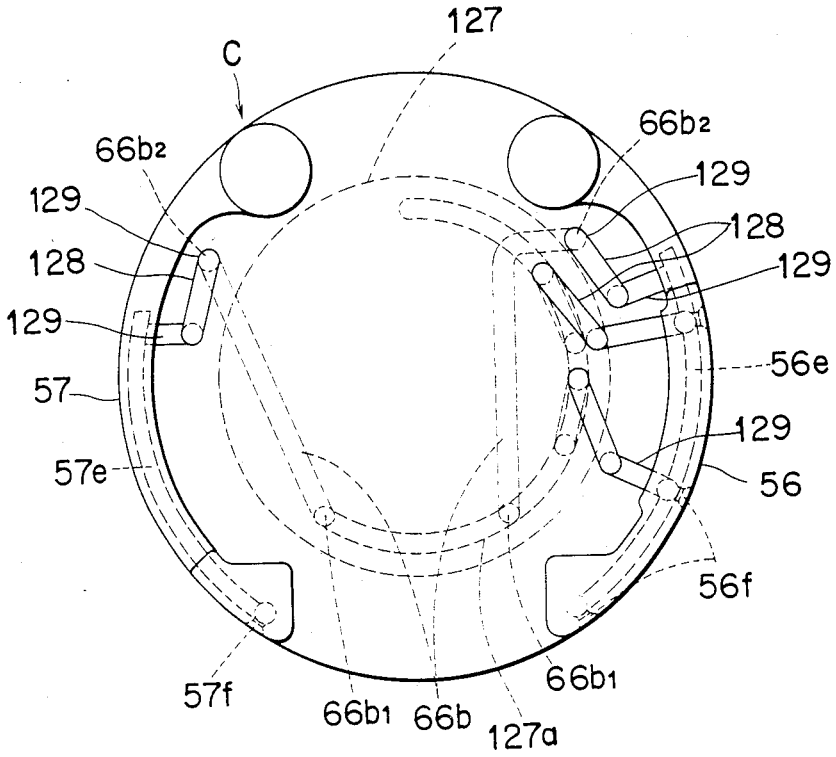
FIG. 28 is a detailed view of a package paper suction transfer mechanism.
Figure 31:
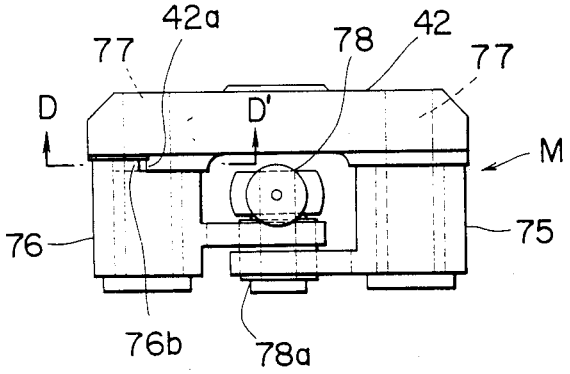
FIG. 31 is a plan view of the above.
Figure 32:
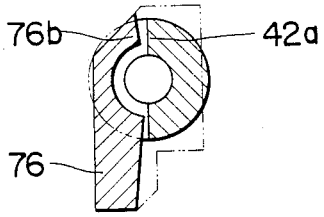
FIG. 32 is a sectional view taken on line D—D′ of FIG. 31.
Figure 29:
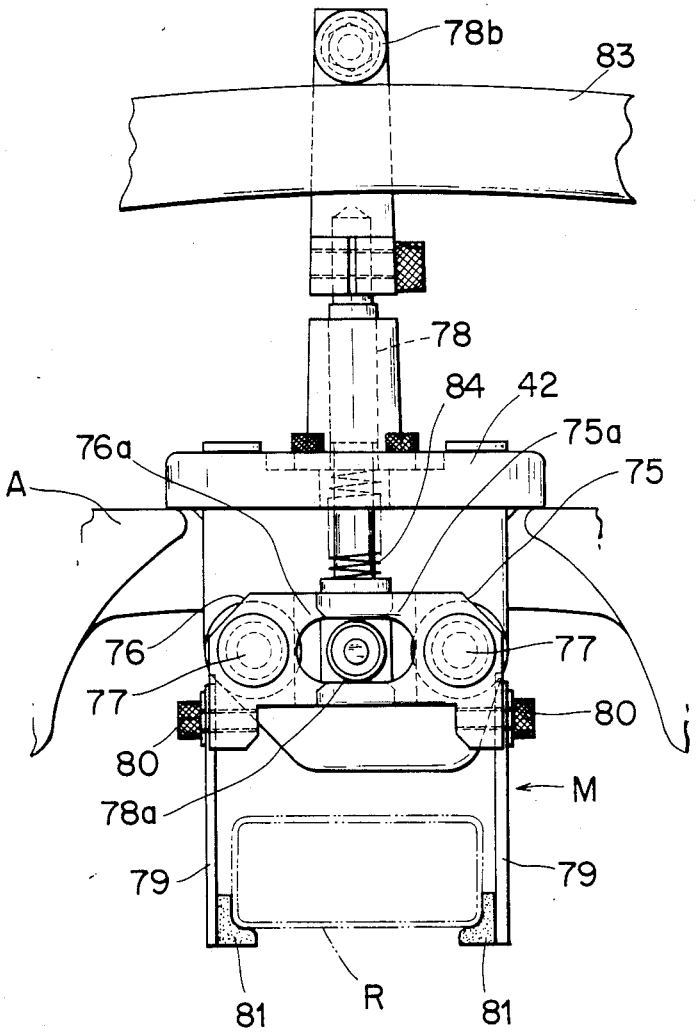
FIG. 29 is a front view of an aluminum foil main presser.
Figure 30:
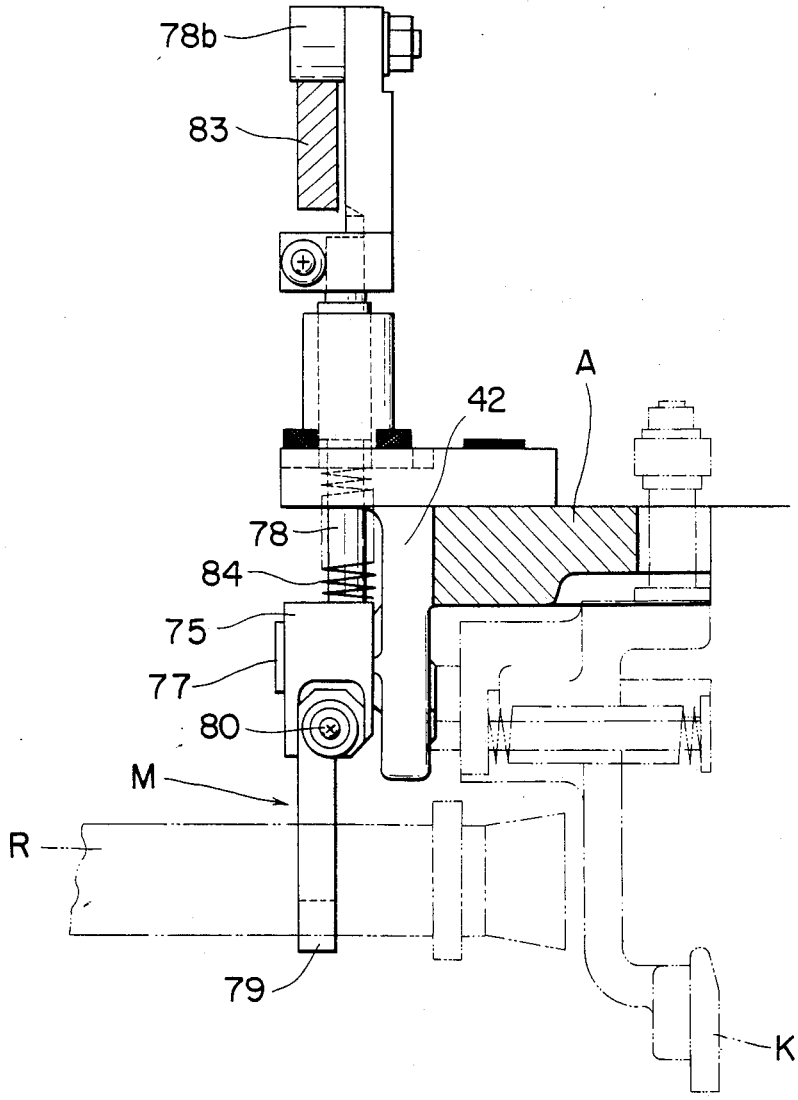
FIG. 30 is a side view of the above.
Figure 33:
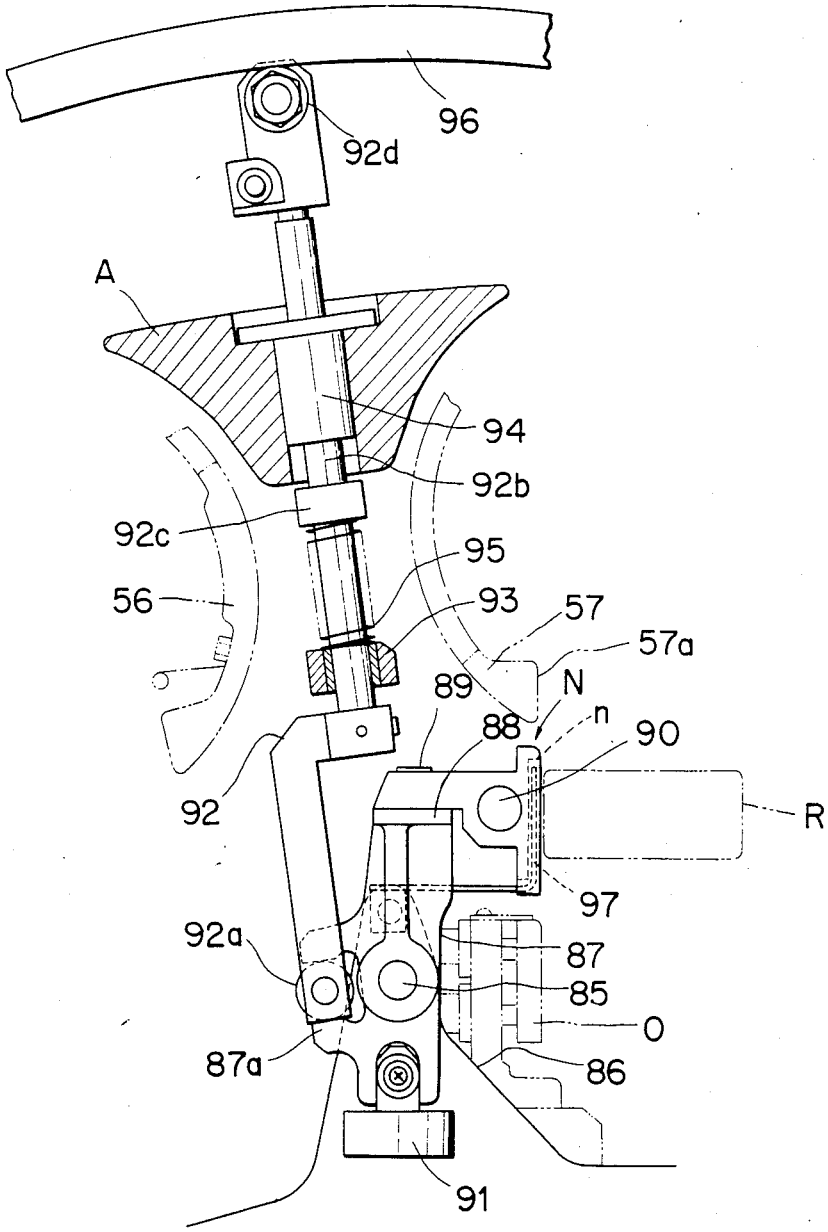
FIG. 33 is a rear view of a heater block.
Figure 35:
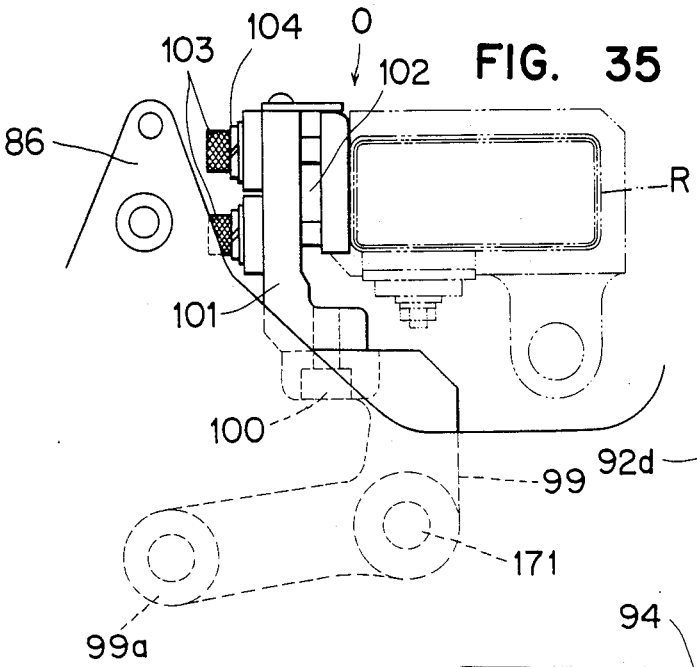
FIG. 35 is a rear view of a cooler block.
Figure 34:
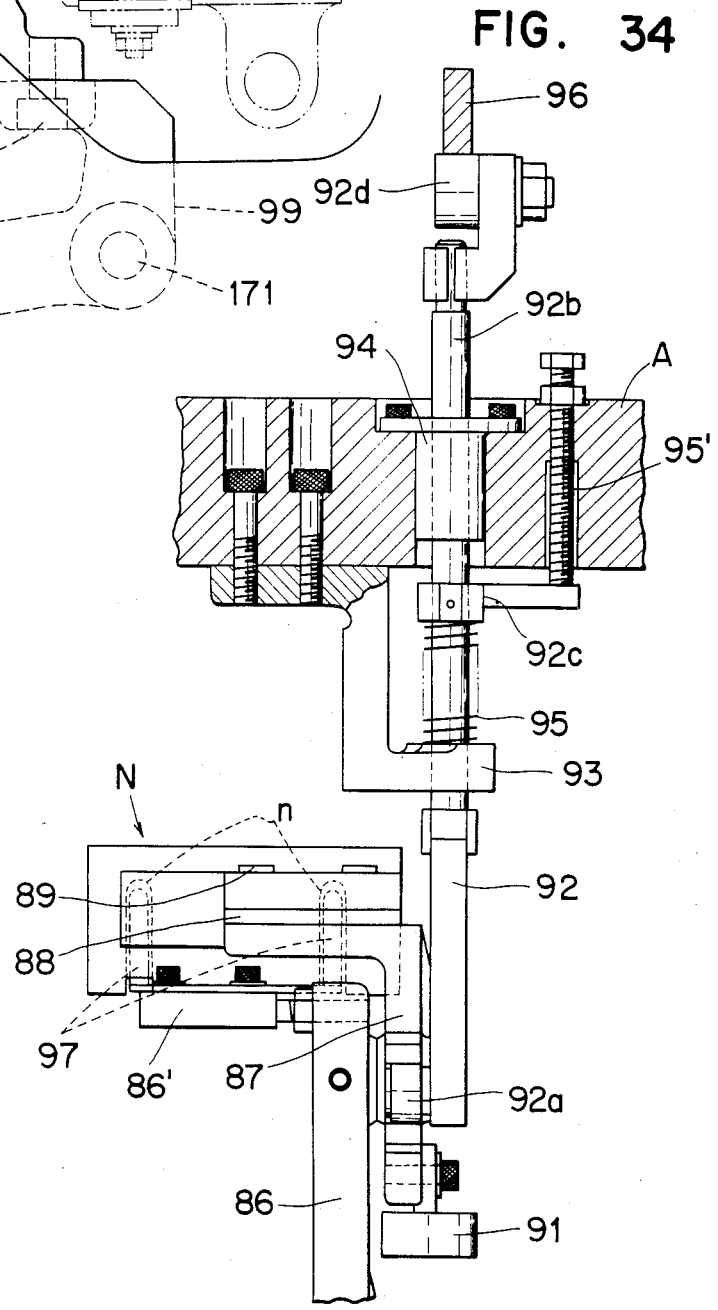
FIG. 34 is a side view of the above.
Figure 36:
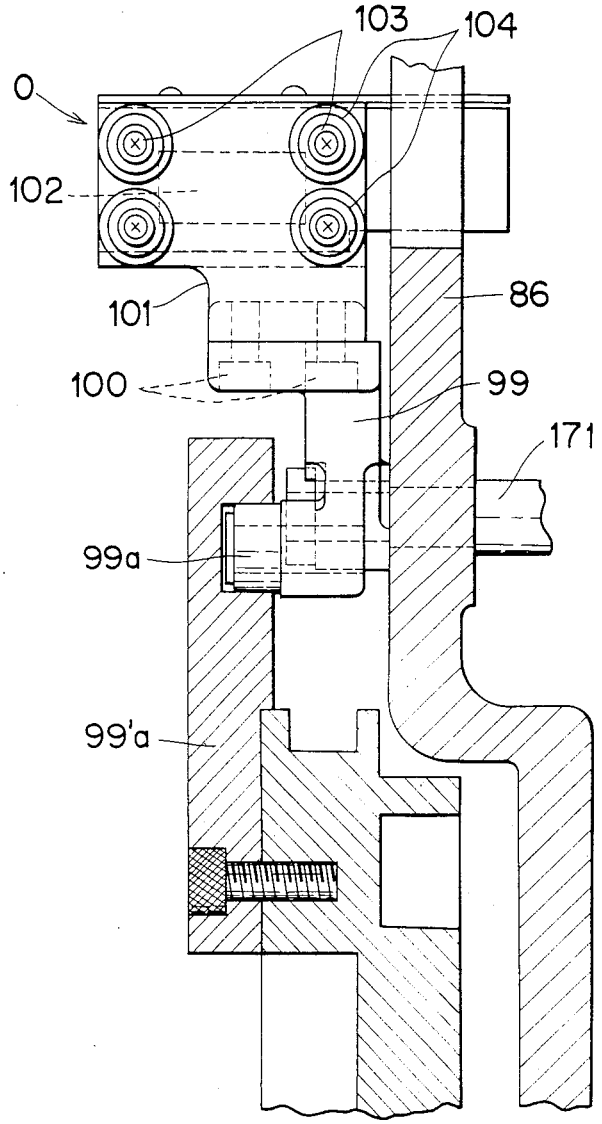
FIG. 36 is a side view of the above.
Figure 37:
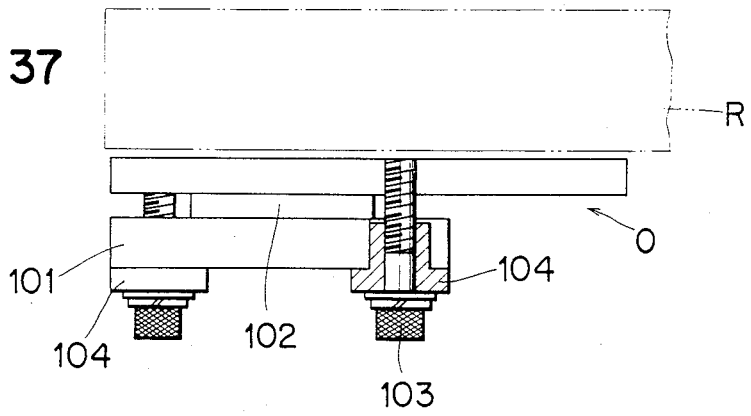
FIG. 37 is a detailed plan view showing a mounting portion of the above.
Figure 38:
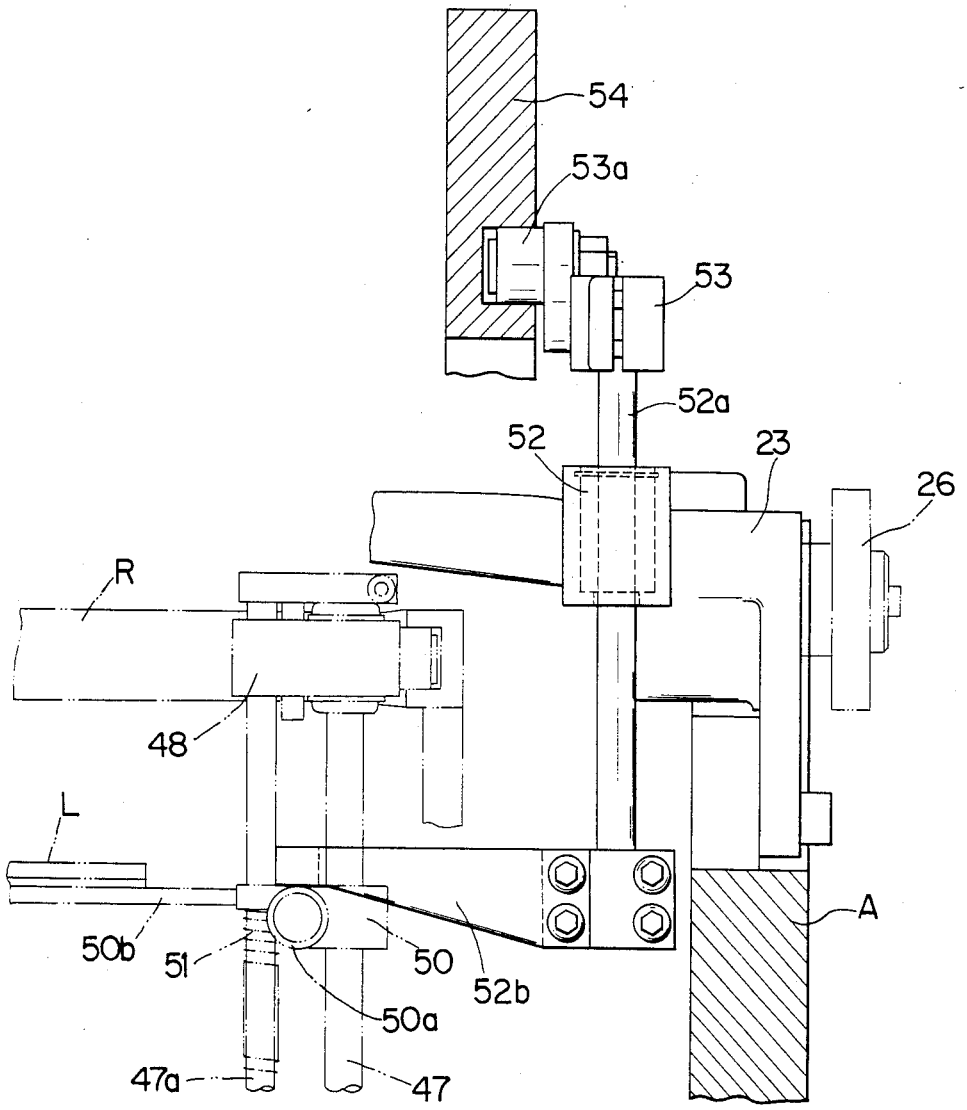
FIG. 38 is a side view of a seaming clamp driving mechanism at the side of aluminum foil.
Figure 39:
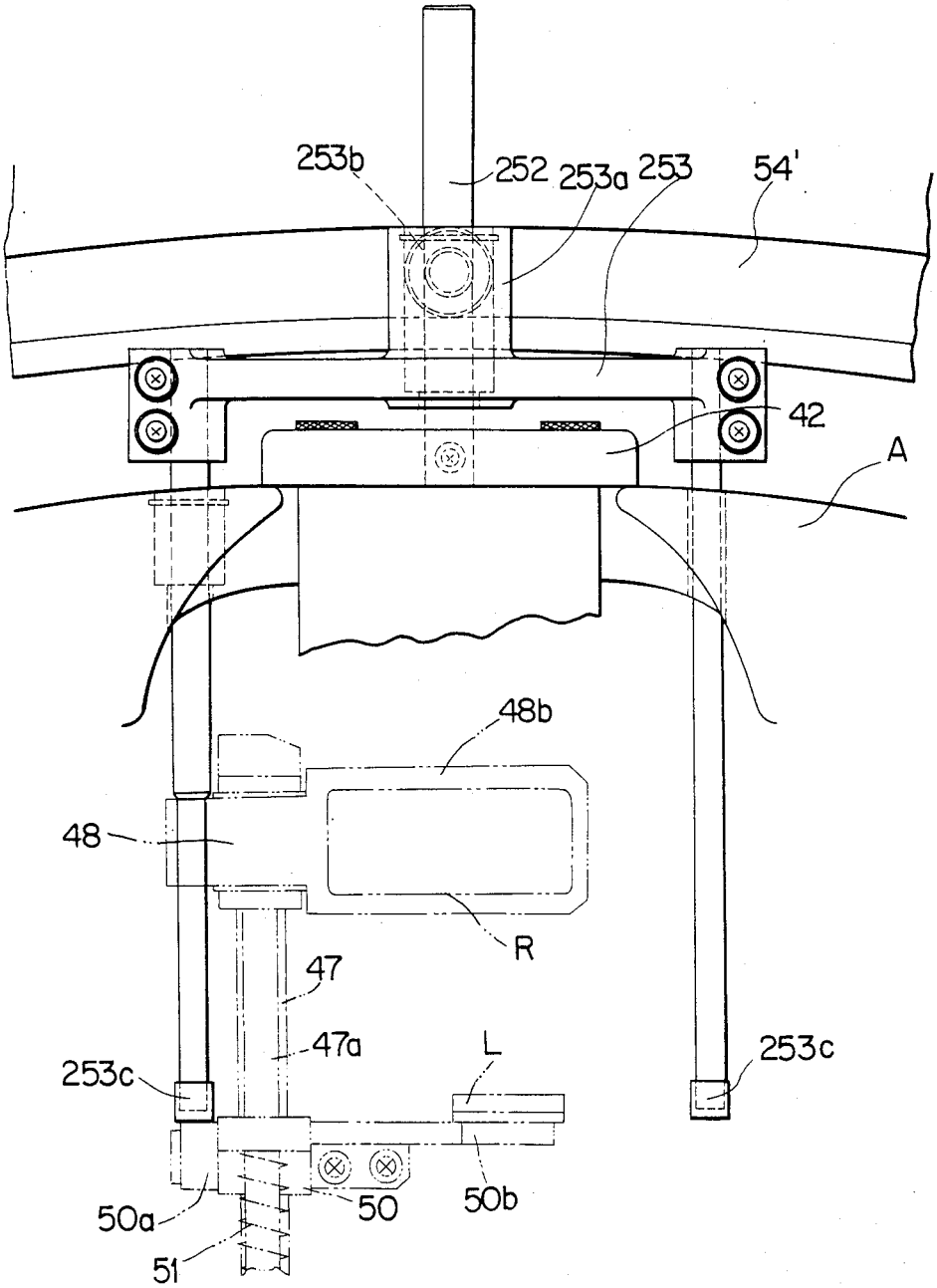
FIG. 39 is a front view of the seaming clamp driving mechanism at the side of package paper.
Figure 40:
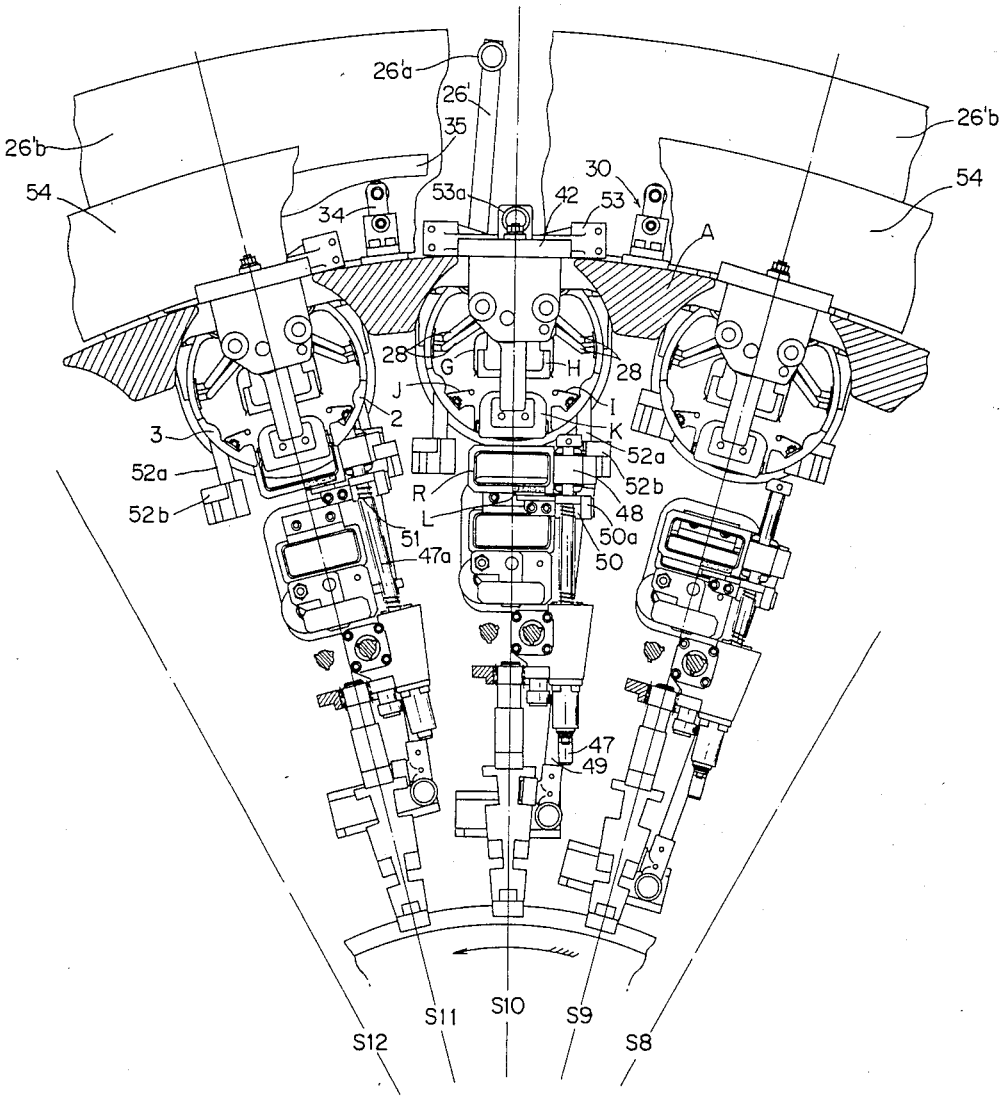
FIG. 40 is a front view of a $\frac{1}{8}$ stage of the full circumference showing an aluminum foil bag forming apparatus using an arbor as a core member and arranged on the packing drum.
Figure 41:
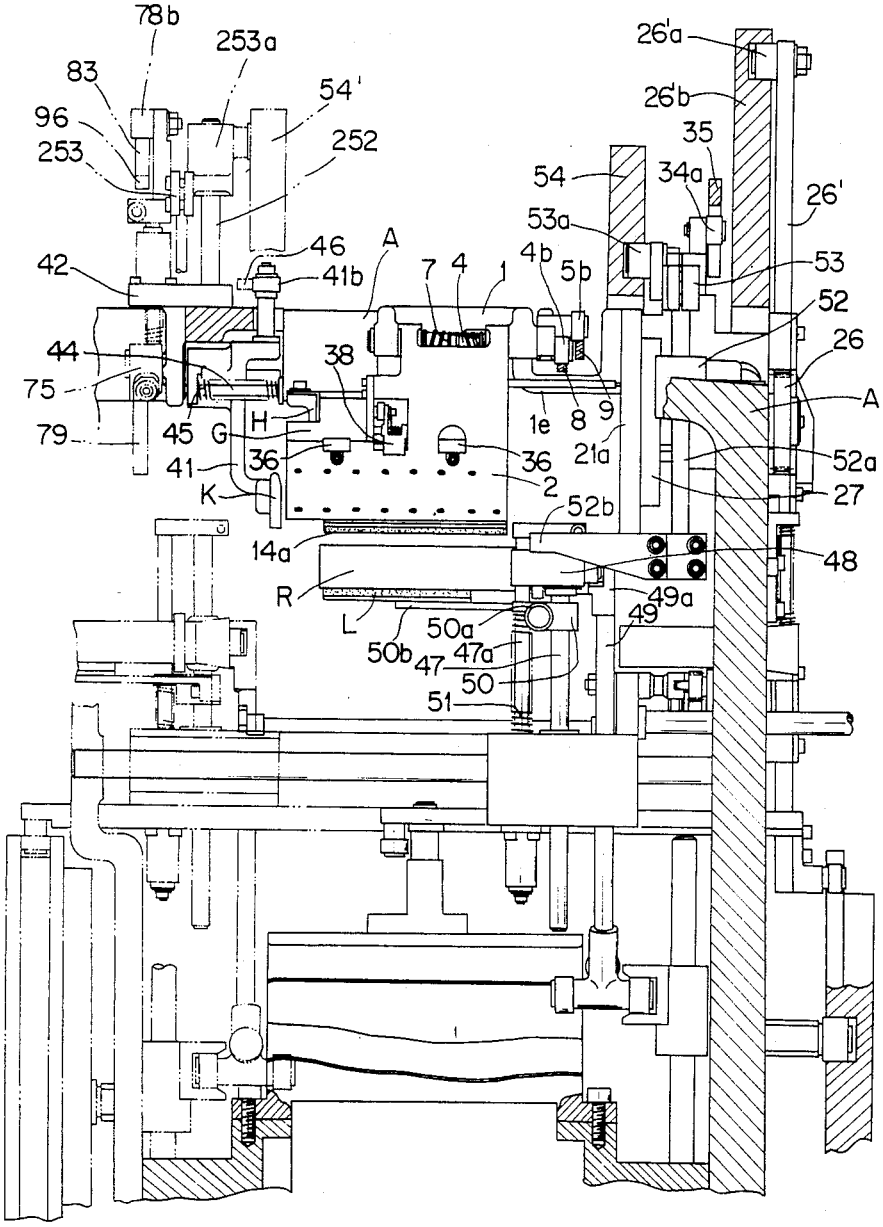
FIG. 41 is a side view of the above but showing only one stage thereof.
Figure 42:
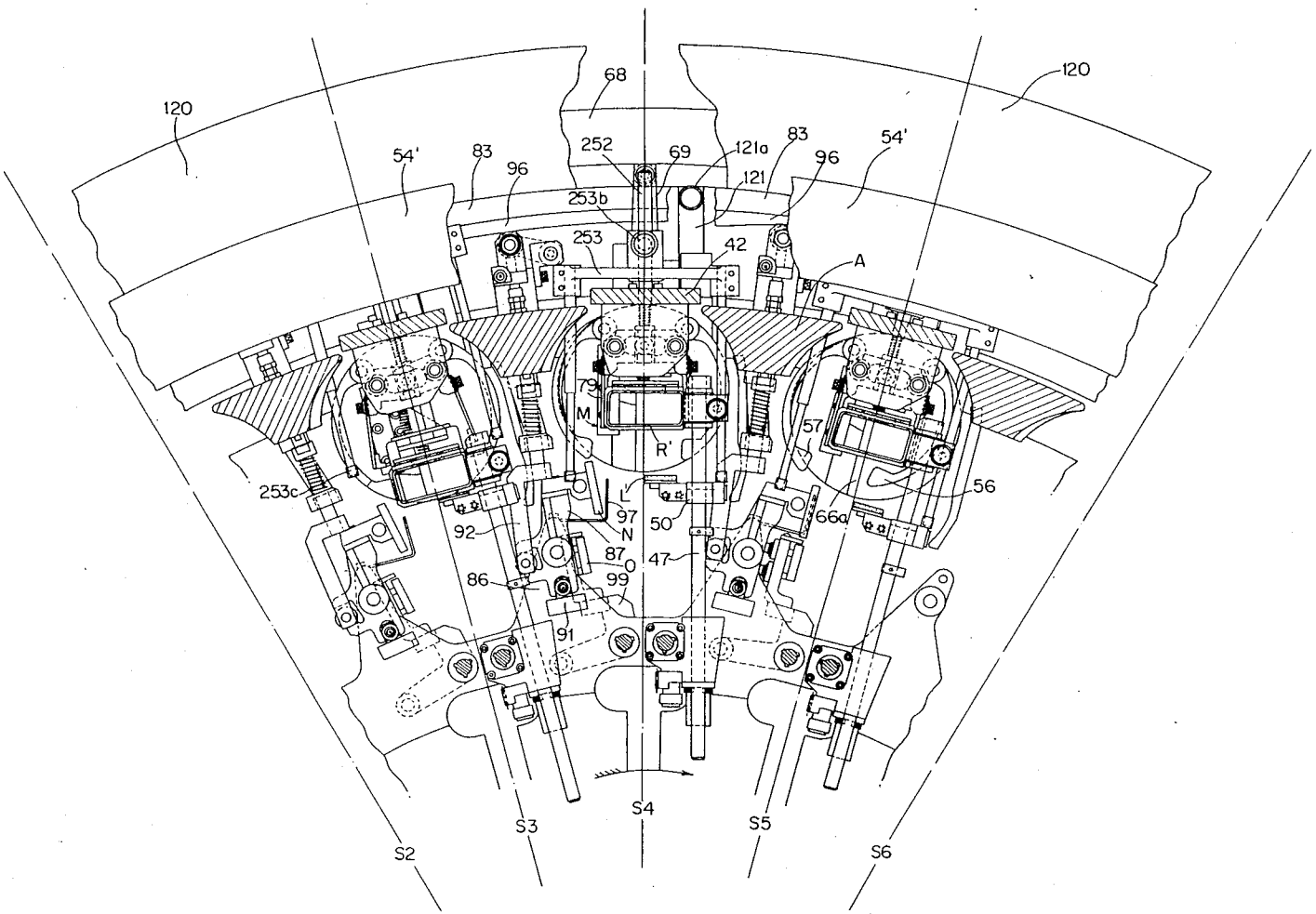
FIG. 42 is a rear view of a $\frac{1}{8}$ stage of the full circumference showing the present apparatus arranged on the packing drum for forming a package paper bag using an arbor as a core member.
Figure 43:
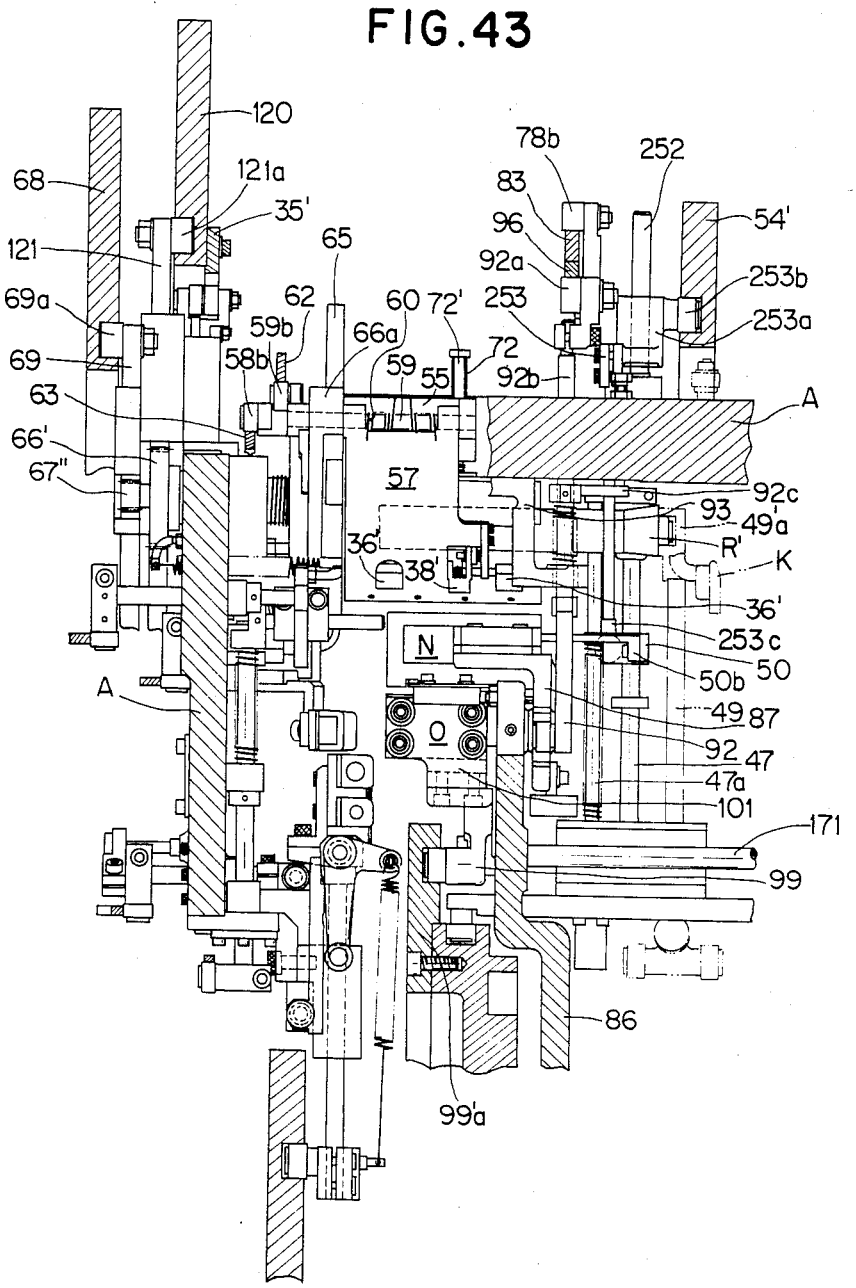
FIG. 43 is a side view of the above but showing only one stage thereof.

As shown in FIG. 3, the packing drum A makes a full rotation by way of 24 operating stages S1, S2, S3, . . . , S24. Within these 24 stages S1 through S24, each of the arbors R arranged in opposite relationship with respect to the corresponding suction rings B and C moves in and out of the suction ring B or C and carries out the bag forming job. At the same time, the shifting of the positions between the corresponding arbors R arranged in tandem or the arbor change takes place.

The aluminum suction ring B has generally an annular outer peripheral configuration as a whole because of the presence of 2 pcs. of arms 2 and 3. Said suction arms 2 and 3 are pivotably arranged inwardly with respect to a bracket 1 by means of shafts 4 and 5.

The bracket 1 is provided, in its plan view configuration, with 4 pcs. of shaft supporting member 1*a* extending in the both directions in a traversing manner with respect to the axial direction at both ends thereof also with respect to the axial direction. Said shafts 4 and 5 are disposed between 2 pcs. of shaft supporting portions 1*a*, 1*a* which are in opposite relationship with respect to each other.

The suction arms 2 and 3, each having an arcuate outer peripheral surface, are bifurcated at the upper portions thereof and include 2 pcs. of pivotally attaching portions 2*a* and 3*a*. By permitting said shafts 4 and 5 to penetrate into said pivotally attaching portions 2 and 3, said 2 pcs. of suction arms 2 and 3 are pivotably provided with respect to the bracket 1.

The bracket 1 is provided with an adjustable stopper 6 screwed into a supporting portion 1*b* at the inner side of the shaft supporting portions 1*a*, and connecting portions 2*b* and 3*b* are provided at the inner sides of the pivotally attached portions 2*a* and 3*a* in such a manner as to restrict the suction arms to pivot outwardly.

7 denotes return springs wound around the shafts 4 and 5, both ends 7*a* of said springs 7 being retained by the suction arms 2 and 3, and an intermediate drawing out end portion 7*b* is retained by a knob 1*c* of the bracket 1, so that the suction arms 2 and 3 which are forced to pivot inwardly by means of a mechanism, as will be described later, are returned until the connecting portions 2*b* and 3*b* are engaged with the stoppers 6.

The suction arms 2 and 3 are integrally connected to the shafts 4 and 5. At one ends of the shafts 4 and 5, levers 4*a* and 5*a* are extended inwardly from the alternate positions with respect to the axial direction. Said levers 4*a* and 5*a* are provided at the tip portions thereof with cam followers 4*b* and 5*b*. Said cam followers 4*b* and 5*b* are engaged with separate cams 8 and 9 which are firmly secured to outside portions of the packing drum A and separately pivot the suction arms 2 and 3 inwardly, when the packing drum A rotates.

Guide walls 2*c* and 3*c* are provided in opposite relationship with respect to each other with an opening space l or an opening portion defined therebetween at the free end portions of the suction arms 2 and 3. A bottom clamp F is positioned within said space l. Two slide shafts 11 and 12 are fixed to a main plate 10 of the bottom clamp F and extend to through-holes 1*d* of the bracket 1. One of the main guide shafts 11 is provided with a stopper 11*a* at the other end thereof in order to regulate the descending position of the bottom clamp F, while the other shaft 12 is adapted solely for preventing the rotation and a return spring 13 is wound therearound.

In the bottom clamp F, a movable plate 14 with a comparatively narrow width is movably mounted under the main plate 10 through mounting shafts 15 which are supported by slide guide members 16 mounted on the main plate 10. At the upper ends of the mounting shafts 15, stopper rings 15*a* for engaging with the slide guide members 16 are mounted. A spring 17 is wound around each of the mounting shafts 15 between the slide guide members 16 and the movable plate 14.

A pressure welded member 14*a* made of a rubber material is mounted on the under-surface of the movable plate 14, and on the under-surface of the main plate 10, a pressure welded member 10*a* made of a rubber material is likewise mounted at positions outside of the both ends of the movable plate 14.

The under-surface $14a_1$ of the pressure welded member 14*a* is formed in an arcuate shape having the same radius as that of the outer periphery of the suction arm, while the under-surface $10a_1$ of the pressure welded member 10*a* is formed in a plane parallel to the upper-surface of the arbor R.

A U-clamp G formed of a resilient plate having a sufficient width and depth for accommodating the bottom clamp F as well as the arbor R therein is firmly secured to the bracket 1 through a mounting plate 18 at the upper portion of the bottom clamp F within the bore defined between the suction arms 2 and 3.

A folding claw H for folding the bottom inner flap $P_1$ is fastened to a position close to one side of the U-clamp G on the mounting plate 18 by a screw 19. The opposite wall portions 20 of the U-clamp G are extended to both side portions of said bottom folding claw H in a state partly cut out to serve as a bottom folding regulating plate 20*a*.

The bracket 1 is fastened at its one side to the mounting flange 21*a* of a main shaft 21 by screws 22 through an extending portion le of the U-shape in its side view, said extended portion le being able to accommodate said levers 4*a* and 5*a* as well as the cam followers 4*b* and 5*b*.

23 denotes a bearing which is fastened to the side portion of the packing drum A by a screw 24 through its ear portion 23*a*. The main shaft 21 is carried at its one side by the bearing 23 through its bearing balls 25. A pinion 26 is firmly secured to the main shaft 21. A rack 26' including a cam follower 26'*a* engaged with a cam 26'*b* secured to the outside portion of the packing drum A is meshed with said pinion 26 in order to drive the main shaft 21 and pivot the suction ring B, while the packing drum A rotates.

27 is a control ring penetrated by the main shaft 21 therethrough. Said control ring 27 is prevented from rotating by a pin 27*b* and ring 27 is biased against a flange 21*a* by a spring 27*c*. The control ring 27 is formed with a ventilation groove 27*a* in which one ends $21b_1$ of throughholes 21*b* formed on the flange 21*a* are opened up. The other ends $21b_2$ of the through-holes 21*b* are connected with one ends of nylon tubes 28 through metal connectors 29, and the other ends of the nylon tubes 28 are connected to through-holes 2*d* and 3*d* of the suction arms 2 and 3 through the metal connectors 29. The through-holes 2*d* and 3*d* are once extended in the circumferential direction and then turned and extended toward the axial direction. At the free end portions of the suction arms 2 and 3, said throughholes 2*d* and 3*d* open a plurality of suction mouths 2*e* and 3*e* outwardly in two rows in the axial direction.

The ventilation grooves 27*a* of the control ring 27 is communicated with a connecting hole 30*c* of a valve 30 through a pipe (not shown). A suction pipe 31 is connected to the valve 30. In the valve 30, a valve body 32 is made to normally open a suction path 30*a* and close an air inlet port 30*b* by means of a spring 33. A mover 34 including a cam follower 34*a* is abutted against the valve body 32. When the mover 34 is actuated by a cam 35, the suction path 30*a* is shut by the valve body 32, and at the same time, the air inlet port 30*b* is opened to effect a vacuum break.

In the suction arm 2, a stopper 36 is fastened by a screw 37 in a manner as to define a supporting groove 36*a* for effecting positioning of the end of the aluminum foil P, when the suction arm 2 receives it from the aluminum foil feed drum D.

Also, between said two stoppers 36, a clamping claw 38 for clamping the end of the aluminum foil P is pivotably supported by a shaft 39 and normally biased in the clamping direction by a spring 40.

A cam follower 38*a* is provided at the other side of the clamping claw 38 through a shaft 39. When the suction ring B is pivoted, the clamping claw 38 is opened by a cam (not shown) fixed to the packing drum A for receiving the end portion of the aluminum foil P fed by the aluminum foil feed drum A and also for normally clamping the aluminum foil P in order to prevent the dropping thereof when the suction is cut. For the same reason, the other suction arm 3 is also provided with a clamping claw. On the inner sides of the free end portions of the suction arms 2 and 3, folding claws I and J formed of a resilient plate are mounted in order to fold the body inner flap $P_2$ and the body outer flap $P_3$.

In one sides of the two suction arms 2 and 3, a folding claw K is movably provided in the axial direction of the suction ring B and in a position close to the space l for folding the bottom outer flap $P_4$. The bottom folding claw K is mounted on a slide block 41. Said slide block 41 is movably mounted on the shaft 43 of a bracket 42 fixed to the outer periphery of the packing drum A, and normally biased in the departing direction with respect to the suction ring B by a spring 45 provided between the slide block 41 and the shaft 44 for preventing the rotation, and progressed forwardly with respect to the suction ring B by a cam 46 through a cam follower 41*b* mounted on a pin 41*a* of the slide block 41.

The arbor R of a square sleeve shape is movably arranged in the radial direction of the packing drum A and held by an arm 48*b* opposite to a slide block 48. Said slide block 48 is slidably mounted on a shaft 47 parallel to said moving direction. A cam follower 48*a* for the slide block 48 is engaged with a yoke shaped actuating member 49*a* mounted on a rod 49. Said rod 49 is extended in the radial direction from the main cam mechanism provided at the central portion of the packing drum A. Consequently, the arbor R is moved up and down in accordance with the rotation of the packing drum A. A shaft 47*a* for preventing the rotation is provided in parallel to the shaft 47.

Another slide block 50 is mounted on the shafts 47 and 47*a*, and a seaming clamp L is supported by a supporting plate 50*b* with respect to said slide block 50. The seaming clamp L is normally biased in the abutting direction against the arbor R by a spring 51.

In the outer peripheral portion of the packing drum A, shafts 52*a* are slidably penetrated into the both ends of a supporting block 52 provided on the bearing 23. At one ends of said shafts 52*a*, a fork shaped, associatingly movable rod 53 including a cam follower 53*a* at its intermediate portion are mounted, and the cam follower 53*a* is engaged with a cam 54 mounted on the outside portion of the packing drum A. Also, at the other end of one of said shafts 52*a*, a presser piece 52*b* is provided for abutting against the cam follower 50*a* of the slide block 50 in the seaming clamp L in the resisting direction with respect to the spring 51, so that the seaming clamp L is departed from the arbor R by the presser pieces 52*b* actuated by a cam 54 resisting the spring 51 while the packing drum A is rotated.

The package paper suction ring C includes two suction arms 56 and 57, the suction arm 56 being arranged pivotable inwardly while the other suction arm 57 being pivotable outwardly by means of shafts 58 and 59 with respect to a bracket 55, and is formed substantially in an annular outer peripheral configuration as a whole. However, due to the positional relationship for receiving the package paper Q, an extended portion 56′ of the suction arm 56 extending in the axial direction is formed wider in its width compared with an extended portion 57′ of the other suction arm 57.

The bracket 55 is provided, in its plan view configuration with 2 shaft supporting members 55*a* extending in the both directions in a traversing manner with respect to the axial direction at one end thereof also with respect to the axial direction. Said shafts 58 and 59 are disposed between said shaft supporting portions 55*a* and the mounting flange 66*a* which are in opposite relationship with respect to each other in the axial direction.

The suction arms 56 and 57 having an arcuate outer peripheral surface are bifurcated at the upper portions thereof excluding said extended portions 56′ and 57′ and include two pivotally attaching portions 56*a* and 57*a*. By permitting said shafts 58 and 59 to penetrate into said pivotably attaching portions 56*a* and 57*a*, said 2 pcs. of suction arms 56 and 57 are pivotably provided with respect to the bracket 55.

The bracket 55 is provided with an adjustable stopper 55*c* fastened to a supporting portion 55*b* by a screw at the inner side of the shaft supporting portion 55*a*. At the pivotally attaching portion 56*a* in the suction arm 56, a connecting portion 56*b* is extending over the bracket 55 and reaching to a position opposite to the stopper 55*c*. A shaft supporting portion 57*b* extending under the bracket 55 is provided at the pivotally attaching portion 57*a* of the suction arm 57, and at the same time, said shaft supporting portion 57*b* is provided with an adjustable stopper 57*c* retaining the under-surface of the bracket 55. Consequently, the suction arm 56 is restricted to effect such pivotal movement as to spread outwardly. On the other hand, the suction arm 57 is restricted to effect such pivotal movement as to retreat inwardly.

60 denotes return springs wound around the shafts 58 and 59, both ends 60*a* of said springs 60 being retained by the under-surfaces or over-surfaces of the suction arms 56 and 57, and an intermediate drawing out portion 60*b* is retained by the under-surface or the over-surface of the bracket 55, so that the suction arms 56 and 57 forced to pivot inwardly or outwardly by mechanisms as will be described later are returned to their initial positions by means of stoppers 55*c* and 57*c*.

The suction arms 56 and 57 are integrally connected to the shafts 58 and 59. At one ends of the shafts 58 and 59, levers 58*a* and 59*a* are extended inwardly from the alternate positions-with respect to the axial direction. Said levers 58*a* and 59*a* are provided at the tip portions thereof with cam followers 58*b* and 59*b*. Said cam followers 58*b* and 59*b* are engaged with separate cams 62 and 63 which are firmly secured to the outside portions of the packing drum A. Because of this structure, when the packing drum A is rotated, the suction arm 56 is pivoted inwardly and the suction arm 57 is pivoted outwardly.

Guide walls 56*d* and 57*d* are disposed in opposite relationship with respect to each other with a space l or an opening portion defined therebetween at the free end portions of the suction arms 56 and 57. Within said space l or the opening portion, a bottom clamp F′ is positioned.

In the bottom clamp F′ a movable plate 114 with a comparatively narrow width is movably provided under the main plate 110 through mounting shafts 115 which are supported by slide guide members 116 mounted on the main plate 110. At the upper ends of the mounting shafts 115, stopper rings 115*a* for engaging with the slide guide members 116 are mounted. A spring 117 is wound around each of the mounting shafts 115 between the slide guide members 116 and the movable plate 114. The main plate 110 is movably provided with respect to a mounting plate 110′ using the slide guide members 116 as the mounting shafts thereof. Said slide guide members 116 are supported by slide guide members 116′ mounted on a mounting plate 110′ At the upper ends of the slide guide members 116, stopper 115′*a* for engaging with the slide guide members 116′ are provided. Between said slide guide members 116′ and the main plate 110, springs 117′ are provided around the slide guide members 116.

A pressure welded member 114*a* made of a rubber material is mounted on the under-surface of the movable plate 114, and on the under-surface of the main plate 110, a pressure welded member 110*a* made of a rubber material is likewise mounted at positions outside of the both ends of the movable plate 114. The under-surface 114*a*$_1$ of the pressure welded member 114*a* is formed in an arcuate shape having the same radius as that of the outer periphery of the suction arm, while the under-surface 110*a*$_1$ of the pressure welded member 110*a* is formed in a plane parallel to the upper surface of the arbor R.

In other words, the bottom clamp F′ is fastened to a rack 65 by screws 64 through a metal connector 64. Said rack 65 is arranged to be movable within a mounting flange 66*a* and meshed with a pinion 67′ mounted on one end of a transmission shaft 67 which is concentrically disposed within a main shaft 66 for supporting the suction ring C, and a pinion 67″ mounted on the other end of the transmission shaft 67 is meshed with a rack 69 having a cam follower 69*a* engaged with a cam 68 secured to the outside portion of the packing drum A. Consequently, when the packing drum A is rotated, the bottom clamp F′ is caused to move up and down.

The rack 69 includes a portion where no teeth are formed in order not to engage with the pinion 67″. Said portion of the rack 69 having no teeth corresponds to a position where the under-surface 114*a* of the pressure welded member 114 of the bottom clamp F′ is formed in the same radius as that of the outer periphery of the suction arms 56 and 57. The arrangement being such that when the suction ring C is pivoted, the bottom clamp F′ is not actuated. In order to prevent idle movement at this time a ball 71 biased by a spring 70 is fitted in a recess 65*a* defined on the rack 65 within the mounting flange 66*a*.

A pinion 66′ is secured to the main shaft 66, and meshed with a rack 121 having a cam follower engaged with a cam 120 secured to the outside portion of the packing drum A, so that when the packing drum A is rotated, the main shaft 66 is driven to pivot the suction ring C.

A U-clamp G′ is movably provided by means of slide shafts 72 and 72′ with respect to the bracket 55, and biased toward the guide walls 56*d* and 57*d* of the suction arms 56 and 57 by means of a spring 73 so that it is normally positioned in the close vicinity of the walls 56*d* and 57*d*, and the descending position thereof is regulated by a stopper ring 72′*a*. The U-clamp G′ formed of a resilient plate has sufficient depth and width for accommodating the bottom clamp F′ and arbor R.

127 is a control ring penetrated by the main shaft 66 therethrough. Said control ring 127 is prevented from rotating by a pin 127*b* and ring 127 is biased against a flange 66*a* by a spring 127*c*. The control ring 127 is formed with a ventilation groove 127*a* in which one ends 66*b*$_1$ of throughholes 66*b* formed on the flange 66*a* are opened up. The other ends 66*b*$_2$ of the through-holes 66*b* are connected with one ends of nylon tubes 128 through metal connectors 129, and the other ends of the nylon tube 128 are connected to through-holes 56*e* and 57*e* of the suction arms 56 and 57 through the metal connectors 129. The through-holes 56*e* and 57*e* are once extended in the circumferential direction and then turned and extended toward the axial direction. At the free end portions of the suction arms 56 and 57, said through-holes 56*e* and 57*e* open a plurality of suction mouths 56*f* and 57*f* outwardly in two rows in the axial direction. The ventilation groove 127*a* of the control ring 127 is connected with a valve through a pipe in the same manner as the aluminum foil suction ring B.

The suction ring C is provided with a stopper 36′ for positioning the package paper Q when received, as well as its clamping claw 38′ as in the case with the suction ring C.

An aluminum main presser M is provided at one side of the U-clamp G′ in its maximum ascended position with respect to the axial direction. In the aluminum main presser M, 2 pcs. of L-shaped to-be-actuated elements 75 and 76 are pivotably attached to shafts 77 with respect to the bracket 42 fixed to the outer periphery of the packing drum A, one side portions of said L-shaped to-be-actuated elements 75 and 76 being formed with fork shaped connectors 75*a* and 76*a*, an actuator 78*a* of an actuating rod 78 being engaged to said fork shaped connectors 75*a* and 76*a*, the other side portions thereof being provided with supporting plates 59 fastened by screws 80. The free end portions of the supporting plates 79 are provided with each of presser pieces 81 made of a rubber material. The other end of the actuating rod 78 is provided with a cam follower 78*b* which is engaged with a cam 83 secured to the outside portion of said packing drum A. As the packing drum A rotates, the supporting plates 79, which are normally biased in a released state by means of a spring 84, are closed, so that the presser pieces 81 maintain the state of the body as it is after the seaming clamp L of the aluminum foil P is escaped from the arbor R.

L-shaped actuators 75 and 76 include collide-and-fit portions 76*b* around the shafts 77 with respect to the stoppers 42*a* of the brackets 42 and when the portions 76*b* are brought to be in a collide-and-fit relation with the stoppers 42*a*, a predetermined released state is maintained.

A folding claw I′ formed of a resilient plate for folding the body is provided at the inner side of the free end portion of the suction arm 56.

N denotes a heater block which is provided right under and in close vicinity of the suction arm 57. The heater block N is fastened to an oscillating plate 87 through a heat insulating material 88 by a screw 89, said oscillating plate 87 being oscillatable by means of a shaft 85 with respect to a bracket 86. A heater 90 is stored in the heater block N.

A weight 91 is hung down from the other side of the oscillating plate 87 in order to offset the force of inertia. An actuator 92*a* of an actuating member 92 is engaged with a fork-shaped portion 87*a* formed at the intermediate portion of the oscillating plate 87, and the actuating rod 92*b* which is connected to said actuating member 92 is slidably carried by bearings 93 and 94, and at the same time, the heater block is progressed forwardly by means of a spring 95 interposed between the bearing 93 and a collar 92*c*. The space defined between the heater block N and the arbor R can be adjustable by abutting the collar 92*c* against an adjustable stopper 95'. The actuating rod 92*b* is provided with a cam follower 92*d* at its outer end, and the heater block N is made retreated by a cam 96 through the actuating rod 92*b* and the actuating member 92. Two cutting-out grooves n are formed on the plane of the heater block N which faces with the arbor R. Plates 97 adapted to prevent the flap from escaping are fastened to the bracket 86 through the supporting member 86', and rested in said grooves n in the state having an even surface with respect to the heater block N. Thus, when the heater block N is released due to the stopping of the movement of the machine, etc., the flap is prevented from escaping.

Right under the heater block N, a cooler block O is arranged. The cooler block 0 is fastened to a holder 101 by bolts through a thermoelectric element 102 for which Peltier effect is used, said holder 101 being fastened to one side of an oscillating plate 99 by screws 100, and the oscillating plate 99 being pivotably mounted on a shaft 171. Between the bolts 103 and the holder 101, heat insulating materials 104 are interposed. At the other side of the oscillating plate 99, a cam follower 99*a* is provided and actuated by a cam 99'*a* to advance or retreat the plate 99 with respect to the path for the arbor R at every predetermined cycle. Instead of the thermoelectric element 102, other cooling devices may be employed.

In the outer peripheral portion of the packing drum A, a fork-shaped associatingly movable rod 253 is slidably provided by means of its intermediate engaging sleeve portion 253*a* with respect to a supporting shaft 252. A cam follower 253*b* provided at one side of said engaging sleeve portion 253*a* is engaged with a cam 54' provided at the outside of the packing drum A. The end portion 253*c* of said associatingly movable rod 253 is abutted against a cam follower 50'*a* of a slide block 50 in the seam clamping L in the resisting direction with respect to a spring 51. When the packing drum A is rotated, the seaming clamp L is departed from the arbor R by resisting the spring 51 actuated by the cam 54'.

With the above constituted, when each of the suction rings 3 approaches the aluminum foil feed drum D in accordance with the rotation of the packing drum A, the pinion 26 is rotated through the rack 26' by means of the cam 26'*b*. As a result, the opening portion defined between the free end portions of the suction arms 2 and 3 is brought to be in opposite relationship with respect to the aluminum foil feed drum D. The aluminum foil P of a predetermined dimension is fed from the aluminum feed drum D and abutted against the supporting groove 36*a* of the stopper 36, and the positioning of the aluminum foil P is effected. Then, the aluminum foil P is delivered to the suction ring B by means of the rotation of the packing drum A and absorbed by the suction mouths 2*e* and 3*e* in an evenly spread state with respect to the right and left suction arms 2 and 3. At this moment, the bottom clamp F is served to position the aluminum foil f correctly on the outer periphery of the suction ring B by filling the opening portion defined between the suction arms 2 and 3 with itself to complete a concentric annular configuration.

When the receipt of the aluminum foil P is completed, the suction ring b is rotated at 243° counter-clockwise and brought to be in a position opposite to the arbor R with the opening portion thereof facing toward the central portion of the packing drum A.

Thereafter, the arbor R is moved toward the suction ring B by means of the yoke shaped driving member 49*a* and entered into the suction ring B through the opening portion defined between the suction arms 2 and 3. At this moment, when the arbor R is moved for 3 m/m after contacting the aluminum foil P, the suction for the suction mouths 2*e* and 3*e* is abruptly cut. As a result, the suction arms 2 and 3 are released from supporting the aluminum foil P. Then, the aluminum foil P is sandwiched between and held by the bottom clamp F and the arbor R, and moved into the suction ring B in that state.

The aluminum foil P is provisionally folded arount its body portion by the opposing guide walls 2*c* and 3*c* formed on the free end portions of the suction arms 2 and 3. The arbor is then entered into the U-clamp with its side body rubbing against the side wall portions 20 of the U-clamp G. As a result, the formal folding is achieved. At this moment, the bottom inner flap $P_1$ is also folded by the bottom folding claw H mounted on one side of the U-clamp G, and the bottom folding regulating plate 20*a*, which is mounted on the side wall portions 20 in an extended manner, is served to prevent the triangle ear portions from being escaped, so that correct folding can be effected.

Immediately after the above-mentioned state, the suction arm 2 is pivoted inwardly by the cam 8, and the body inner flap $P_2$ is folded by the rubbing motion of the folding claw I mounted thereon. Then, the suction arm 3 is pivoted inwardly by the cam 9, and the body outer flap $P_3$ is folded by its folding claw J in the same manner.

Thereafter, only the suction arm 2 is returned to its initial position and in the above-mentioned state, i.e., the inner and outer body flaps $P_2$ and $P_3$ being pressed by the folding claw J of the suction arm 3, the seaming clamp L is caused by the cam 54 to retreat the presser piece 52*b* and approaches to the arbor R. The inner and outer body flaps $P_2$ and $P_3$ are pressed by the seaming clamp L. Then, the suction arm 3 is also returned to its initial position.

Thereafter, a folding claw K for folding the bottom outer flap $P_4$ is progressed forwardly to the folding position by the cam 46. In this state, the arbor R is retreated together with the seaming clamp L. On this occasion, the folding of the bottom outer flap $P_4$ is also effected by the folding claw K, and the guide walls 2*c* and 3*c* are served to prevent the triangle ear portions $P_5$ from escaping.

The arbor R is moved to the next working process together with the seaming clamp L for receiving the bag making operation using the package paper Q. The package paper bag is used as an outer bag of the aforementioned aluminum inner bag. The suction ring B is rotated at through 243° in the clockwise direction in order to receive the next aluminum foil P, and thereby maintains its attitude ready to receive the aluminum foil P.

On the other hand, according to the rotation of the packing drum A, each suction ring C is rotated to receive a package paper Q which is cut in a predetermined dimension beforehand from the package paper feed drum E. Other motion at the time of receipt of the paper is the same as already described with respect to the suction ring B of the aluminum foil P, but the package paper is received in a nonsymmetric state with respect to the suction arms 56 and 57.

When the receipt of the package paper Q is completed, the suction ring C is rotated through 214° in the counter-clockwise direction and brought to be in a position opposite to the arbor R with the opening portion facing toward the central portion of the packing drum A.

Thereafter, the arbor R with the afore-mentioned aluminum bag already formed is moved toward the suction ring C and enters into the suction ring C through said opening portion of the suction arms 56 and 57. When the arbor R is moved for 3 m/m after being contacted with the package paper Q, the suction for the suction mouths 56*f* and 57*f* is abruptly cut. As a result, the suction arms 56 and 57 are released from the job for supporting the package paper Q. Thus, the package paper Q is sandwiched between and held by both the bottom clamp F' and the arbor R and moved into the suction ring C in that state.

The package paper Q is provisionally folded with its body portion by the opposing guide walls 56*d* and 57*d* at the free end portions of the suction arms 56 and 57. While entering, the arbor R lifts up the U-shaped clamp G' until it reaches to the maximum ascended position. When the arbor R completely enters into the U-clamp G', the formed folding is effected in the maximum ascended position Next, the aluminum main presser M disposed at the outside of the maximum ascended position of the U-clamp G' is closed to clamp a portion of the aluminum foil P exposed from the package paper Q in the axial direction. In this state, the seaming clamp L escapes from the arbor R.

Next, in the escaped state in which the suction arm 57 is pivoted outwardly, the suction arm 56 is pivoted toward the closing direction thereof, thereby permitting the folding claw I' to fold the hanging body portion of the package paper Q. After the package paper Q is pressed by the seaming clamp L again, the suction arm 57 is returned. After the aluminum main presser M is released, the suction arm 56 is returned. Then, the arbor R and the bottom clamp F' are retreated backwardly. In the above-mentioned state of the arbor R with the package paper Q wound around the body portion thereof, the package paper Q is transferred from the U-clamp G' to the guide walls 56*d* and 57*d* but right thereabove, and supported thereby. Simultaneously, the body outer flap $Q_2$ is folded by the guide wall 57*d*.

The body outer flap $Q_2$ is applied with an adhesive agent beforehand. In the case the agent is a hot melt, it is melted by the heater block N provided right thereunder and cooled and hardened by the cooler block 0 to complete the adhesion.

Since the present invention is constituted as mentioned in the foregoing, in the process of forming a double bag, the packing paper folding operation is carried out within the suction member which receives the packing paper. Consequently, dislocation and loosening of the packing paper can be completely prevented with respect to the arbor. Thus a high speed operation and uniform quality of goods can be obtained.

What is claimed is:

1. A packing paper receiving and folding apparatus comprising:

a rotating packing drum formed with plural pairs of openings therearound with regular circumferential spacings therebetween, each pair including a first opening and a second opening arranged in axial alignment;

a rotating suction ring assembly provided within said rotating packing drum and including a bracket near said second opening and adapted to rotate about an axis, first and second arcuate suction arms pivotally attached to said bracket at first ends thereof to define a gap between second ends, remote from said first ends, and a bottom clamp provided at said gap to form a generally ring-shaped structure around said axis, each arcuate suction arm having openings in a periphery thereof to be connected to a suction source, said first and second arms having respective first and second control means associated therewith, said first arcuate suction arm being normally biased by said first control means outwardly while said opening action being restricted to such an extent that said first arcuate arm will not extend outwardly beyond a circle, said second arcuate suction arm being normally biased by said second control means inwardly while said closing action being restricted to such an extent that said second arcuate arm will not extend inwardly beyond said circle, reciprocating means associated with said bottom clamp to radially reciprocate said bottom clamp away from and toward said gap within said rotating suctionring assembly;

control means for rotating said bracket near said second opening around said axis;

a plurality of arbors each supported radially inwardly of said rotating suction ring assembly within said packing drum, each arbor being wrapped with an inner wrapping sheet;

means for supplying outer wrapping sheets one by one at a predetermined position near a periphery of the rotating packing drum to oncoming second openings, the rotatable suction ring assembly in sychronization with said rotating packing drum to receive one of the outer wrapping sheets at said gap by means of said bottom clamp and said first and second suction arms, a major part of aid outer wrapping sheet being held by suction by the first suction arm while a minor part of said outer wrapping sheet is held by suction by the second arm;

means for rotating said suction ring assembly further so that the received outer wrapping sheet and on said suction ring faces a corresponding arbor;

means for moving said arbor through said gap into the rotating suction ring assembly to hold said received inner wrapping sheet between the arbor and the bottom clamp;

a seaming clamp provided within said rotating packing drum radially inwardly of the arbor and reciprocable into and out of said rotating suction ring assembly through said gap, means for controlling said seaming clamp to move said seaming clamp into said rotating suction ring assembly to hold a free end of the inner wrapping paper against the arbor wrapped therewith;

said rotating suction ring assembly further including therewithin a U-shaped clamp having an open side in facing relation to said gap to receive the bottom clamp and having a size to snugly accommodate the arbor therein with the outer wrapping sheet held thereby, said U-shaped clamp having an ascented position remote from the gap and a descended position close to the gap;

inner wrapping sheet holding means provided on one side of said ascended position of the U-shaped clamp for holding the inner wrapping sheet wrapped around said arbor;

said outer wrapping sheet being held between the U-shaped clamp and the arbor in U-shaped configuration with one leg portion extending outside the U-shaped clamp on a side near the first arcuate arm, said first arcuate suction arm having a folding claw provided outside said leg portion and extending toward said leg portion of the outer wrapping sheet in the U-shaped configuration, aid first arcuate suction arm controllable by said first control means to rotate inwardly said leg portion, said second arcuate suction arm controllable by said second control means to rotate outwardly to avoid interference with said folded one leg portion;

said second arcuate suction arm controllable by said second control means such that it rotates inwardly upon return; and said bottom clamp having means for pushing said arbor together with the outer wrapping sheet out of the U-shaped clamp and the rotating suction arm assembly to further fold said one leg portion by use of said second arcuate suction arm which have rotated inwardly on return.

2. The packing paper receiving and folding apparatus of claim 1, wherein said bottom clamp includes a resilient support section attached to the bracket, a pair of clamping members and an arcuate support member resiliently provided between said pair of clamping members.

3. The packing paper receiving and folding apparatus of claim 1, wherein said seaming clamp is normally urged toward the arbor by said seaming clamp control means.

* * * * *